US006456271B1

(12) United States Patent
Tamai et al.

(10) Patent No.: US 6,456,271 B1
(45) Date of Patent: Sep. 24, 2002

(54) DISPLAY ELEMENT DRIVING DEVICES AND DISPLAY MODULE USING SUCH A DEVICE

(75) Inventors: Shigeki Tamai, Yoshino-gun; Toshio Watanabe, Kitakatsuragi-gun, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/478,003

(22) Filed: Jan. 5, 2000

(30) Foreign Application Priority Data

Feb. 24, 1999 (JP) ..... 11-047064

(51) Int. Cl.[7] ..... G09G 3/36

(52) U.S. Cl. ..... 345/100; 345/89; 345/94; 345/211; 345/204; 713/320

(58) Field of Search ..... 345/87–104, 211–213, 345/204; 377/64, 69; 713/320, 321, 322

(56) References Cited

U.S. PATENT DOCUMENTS 5,523,772 A * 6/1996 Lee ..... 345/98
5,642,127 A 6/1997 Tamai ..... 345/95
5,828,357 A 10/1998 Tamai et al. ..... 345/89
5,917,238 A 6/1999 Tamai ..... 341/41
5,977,944 A * 11/1999 Kubota et al. ..... 345/100
6,002,384 A 12/1999 Tamai et al. ..... 345/95
6,246,399 B1 * 6/2001 Yamane et al. ..... 345/211
6,262,705 B1 * 7/2001 Inoue et al. ..... 345/100

FOREIGN PATENT DOCUMENTS

JP 5-72992 3/1993
JP 9-68949 3/1997

* cited by examiner

*Primary Examiner*—Lun-Yi Lao

(57) ABSTRACT

A clock signal CK, picture data signals R·G·B and a source driver starting pulse signal SPI are cascade-connected between first through eighth source drivers in which eight source drivers LSI are cascade-connected. Each of the source drivers LSI is provided with an output control circuit which, up to the output of the start pulse signal SPI to the source driver LSI on the next stage or up to a predetermined time earlier than the output, stops the output of the clock signal to the source driver LSI at the next stage.

38 Claims, 19 Drawing Sheets

DISPLAY ELEMENT DRIVING DEVICES AND DISPLAY MODULE USING SUCH A DEVICE

FIELD OF THE INVENTION

The present invention relates to a display element driving device which is formed by cascade-connecting a plurality of driving circuits that drive a display element, such as a liquid crystal display element, based upon picture data signals, and concerns a display module using such a display element driving device.

BACKGROUND OF THE INVENTION

FIG. 12 shows a system construction on the source side of a conventional display element driving device used in a liquid crystal display element. Here, the number of pixels of a liquid crystal panel serving as the liquid crystal display element is 800 pixels×3 (RGB) [source side]×600 pixels [gate side].

In the above-mentioned display element driving device, each of source drivers LSI (Large Scale Integrated Circuit) 101 serving as a plurality of driving circuits on the source side carries out a displaying operation with 64 gradations, and drives 100 pixels×3 (RGB). Therefore, the display element driving device on the source side is constituted by 8 source drivers LSI 101.

In the case when the eight source drivers LSI 101 have to be mutually distinguished, the source drivers LSI 101 at the respective 1 to 7 stages are referred to as the first to the seventh source drivers, and the source driver LSI 101 at the last stage is referred to as the eighth source driver.

Each source driver LSI 101 is packaged on a TCP (Tape Carrier Package) (not shown) and used. Here, in general, the TCP refers to a thin package made by bonding a driver LSI onto a film tape.

The above-mentioned display element driving device is provided with a controller 102. Respective voltages outputted from the respective output terminals, VLS, Vcc, GND and Vrefs 1 to 9, of the controller 102 are commonly supplied to the first to the eighth source drivers in parallel with each other. Moreover, various signals outputted from the respective output terminals, LS, R·G·B, SCK, of the controller 102 are also commonly supplied to the first to the eighth source drivers in parallel with each other. Here, a source driver starting pulse signal, outputted from an output terminal SSPI which will be described later, is successively transferred through the first to the eighth source drivers.

The following description will discuss flowing paths of the various signals released from the output terminals LS, R·G·B, SCK, SSPI of the controller 102.

First, signal conductors of picture data signals R·G·B (R, G, B, each having 6 bits) outputted from the output terminals R·G·B of the controller 102, a clock signal CK outputted from the output terminal SCK of the controller 102 and a latch signal LS outputted from the output terminal LS of the controller 102 are inputted to the first to the eighth source drivers in parallel with each other through respective common wires, Here, the source driver starting pulse signal SPI, outputted from the output terminal SSPI of the above-mentioned controller 102, is inputted to the input terminal SPin of the first source driver. The source driver starting pulse signal SPI thus inputted is transferred through the first source driver, and outputted from the output terminal SPout as a source driver starting pulse signal SPO. The source driver starting pulse signal SPO outputted from the first source driver is inputted to the input terminal SPin of the second source driver at the next stage as the source driver starting pulse signal SPI. Thereafter, in the same manner, the source driver starting pulse signal SPI is transferred up to the eighth source driver while being shifted.

Moreover, voltages, such as a power supply voltage Vcc for use in the source driver LSI 101, outputted from the output terminal Vcc of the controller 102, a ground connection electric potential GND electrically connected to the output terminal GND of the controller 102, 64 bit gradation displaying voltages Vrefs 1 to 9 outputted from the output terminals Vrefs 1 to 9 of the controller 102, a liquid crystal panel applying voltage adjustment voltage VLS outputted from the output terminal VLS of the controller 102, are supplied to the first to the eighth source drivers in parallel with each other through the respective common wires in the same manner as the above-mentioned flowing paths of the respective signals. Here, the power supply voltage Vcc, the ground connection electric potential GND, the 64 bit gradation displaying voltages Vrefs 1 to 9, and the liquid crystal panel applying voltage adjustment voltage VLS are, hereinafter, referred to as power-supply-related voltages.

Next, referring to a block diagram of FIG. 13, an explanation will be given of the circuit construction of the source driver LSI 101 shown in FIG. 12 and of the operations of the first to eighth source drivers, while also referring to timing charts of the various signals shown in FIG. 14.

As illustrated in FIG. 13, the source driver LSI 101 is constituted by a shift register 111, a data latch circuit 112, a sampling memory 113, a hold memory 114, a standard voltage generation circuit 115, a D/A converter 116 and an output circuit 117.

To the shift register 111 is inputted the source driver starting pulse signal SPI (see FIG. 14) outputted from the output terminal SSPI of the controller 102 through the input terminal SPin. The source driver starting pulse signal SPI is a signal synchronizing to the horizontal synchronizing signal of picture data signals R·G·B which will be described later. To the above-mentioned shift register 111 is inputted the clock signal CK (see FIG. 14) outputted from the output terminal SCK of the controller 102 through the first to the eighth source driver input terminals CKin.

By using the,source driver starting pulse signal SPI as a start pulse, the shift register 111 of the first source driver shifts the source driver starting pulse signal SPI in response to the first rise of the clock signal CK which has been inputted during the high level period of the source driver starting pulse signal SPI. The source driver starting pulse signal SPI, thus shifted, is outputted from the output terminal SPout of the first source driver as a source driver starting pulse signal SPO, and this is inputted to the input terminal SPin of the second source driver at the next stage. Thus, the source driver starting pulse signal SPI is shifted up to the eighth source driver at the final stage in the same manner.

Here, the picture data signals R·G·B, outputted from the output terminals R·G·B of the controller 102 consist of 6 bits respectively (see FIG. 14). As illustrated in FIG. 13, these picture data signals R·G·B are inputted to the data latch circuit 112 in parallel with each other from the input terminals R1 to 6in, G1 to 6in, B1 to 6in. After having been temporarily latched in the data latch circuit 112, the picture data signals R·G·B are supplied to the sampling memory 113. The above-mentioned picture data signals R·G·B are color digital picture signals consisting of R(Red), G(Green), B(Blue), each having 6 bits (total 18 bits).

The above-mentioned sampling memory 113 samples the picture data signals R·G·B that are sent through the output signals from the respective stages of the shift register 111 in a time divided manner, and stores them until a latch signal LS (outputted from the output terminal LS of the controller 102), which will be described later, is inputted.

Next, these picture data signals R·G·B are inputted to the hold memory 114. At the time when data corresponding to one level period of the picture data signals R·G·B has been inputted to the hold memory 114, they are latched by the latch signal LS inputted from the input terminal LSin. Up to the time when picture data signals R·G·B of the next level period have been inputted from the sampling memory 113 to the hold memory 114, the hold memory 114 holds the data of one level period of the picture data signals R·G·B, and then outputs this to the D/A converter 116. At this time, the shift register 111 and the sampling memory 113 carry out a data acquiring process on the picture data signals R·G·B of the next level period.

Based upon reference voltages that are outputted from the output terminals Vref 1 to 9 of the controller 102 and inputted to the input terminals Vref 1 to 9 of the first to eighth source drivers, the reference voltage generation circuit 115 generates voltages of 64 levels used for gradation display by using, for example, resistance division.

The D/A converter 116 converts the digital picture data signals R·G·B having 6 bits for R, G and B respectively into analog signals. Then, by using the liquid crystal panel applying voltage adjustment voltage VLS outputted from the output terminal VLS of the controller 102 and inputted to the input terminals VLS of the first to eighth source drivers, the output circuit 117 amplifies the analog signal of 64 levels, and outputs to the input terminals (not shown) of a liquid crystal panel through the output terminals XO 1 to XO 100, YO 1 to YO 100, and ZO 1 to ZO 100.

The above-mentioned output terminals XO 1 to XO 100, YO 1 to YO 100 and ZO 1 to ZO 100 respectively correspond to the picture data signals R·G·B requiring 100 terminals for R, G and B respectively. Here, the terminal Vcc and the terminal GND are power supply input terminals for supplying a power supply voltage Vcc and a ground connection electric potential GND to the first to eighth source drivers.

As described above, the display element driving device of the conventional display element driving device has a system on the source side in which: the eight source drivers LSI 101 packaged on TCPs are cascade-connected through the shift registers 111 and various signals and power-supply-related voltages are commonly supplied to the eight source drivers LSI 101.

In recent years, large screens have been developed by using liquid crystal panels, and in the case of the above-mentioned liquid crystal panel having 800 pixels×3 (RGB) [source side]×600 pixels [gate side], the clock signal on the source side requires approximately 60 MHz. When a plurality of source drivers LSI are operated by using such a high-speed clock signal, the power consumption extremely increases. Therefore, such an increase in the power consumption has come to impose a greater burden on the battery capacity in portable liquid crystal display devices.

In general, during a displaying operation of a liquid crystal display element, a plurality of driving circuits for driving the liquid crystal display element always receive signals transmitted from the controller, such as clock signals and display-use picture data signals. Therefore, in all the driving circuits, the inner logics are always operated, with the result that unnecessary charging and discharging electric currents are exerted, causing an increase in the power consumption.

In order to solve this problem, for example, Japanese Laid-Open Patent Application No. 72992/1993 (Tokukaihei 5-72992) and Japanese Laid-Open Patent Application No. 68949/1997 (Tokukaihei 9-68949) disclose methods for reducing power consumption by stopping the operation of an inner logic in an unnecessary driving circuit.

FIG. 15 shows the basic construction of a driving device disclosed in Japanese Laid-Open Patent Application No. 72992/1993 (Tokukaihei 5-72992). In this driving device, a control circuit 122 having a timing generation circuit is installed in each of a plurality of drivers 121i (i=1, 2, . . . , n) that are cascade connected, and when the control circuit 122 is operating a specific driver, signals such as clock signals and RGB signals to be inputted to the respective drivers 121*i* in parallel with each other are not supplied to the other drivers. This arrangement makes it possible to achieve low power consumption.

In FIG. 15, PDI represents a control signal to be inputted to a driver $\mathbf{121}_1$, PDO represents a count-up output, STI represents a start pulse input signal, STO represents a start pulse output signal, L/R represents a shift direction instruction signal, and DS represents a start pulse input/output judgment control signal.

FIG. 16 shows the basic construction of a liquid crystal driving circuit constituting a liquid crystal driving device disclosed in Japanese Laid-Open Patent Application No. 68949/1997 (Tokukaihei 9-68949). In this liquid crystal driving device, a data buffer 132 with a data stop circuit that detects the period from the input to the output of the start signal of the shift register 131 so as to control the operation of the data buffer is installed. The data buffer 132 with the data stop circuit functions so that during an operation of a specific liquid crystal driving circuit, data signals (R·G·B signals), inputted to the respective liquid crystal driving circuits in parallel with each other, are not supplied to the other liquid crystal driving circuits. This arrangement makes it possible to achieve low power consumption.

In FIG. 16, STHL represents a cascade signal, STHR represents a start signal, CLK is a clock signal, R/L represents a shift direction switch signal, DR 0 to DR 7, DG 0 to DG 7, DB 0 to DB 7 represent display data, STB represents a latch signal, and V0 to V255 represent gradation level power supplies. Moreover, C1 to C80 represent inner signals from the shift register 131, and S1 to S240 represent gradation levels that are selected and outputted from gradation level power supplies V0 to V255.

Here, in recent years, there have been ever-increasing demands for low-cost, thin, light-weight, small-size, low-power-consumption apparatuses from the market for display modules such as liquid crystal display modules. For this reason, as one of the methods for responding to the above-mentioned demands, another method has been proposed in which, different from the conventional arrangement that supplies respective signals to a plurality of driving circuits in parallel with each other through common signal conductors, signal conductors are connected between driving circuits adjacent to each other so that the respective signals are supplied to the driving circuits.

As described above, since the respective signals are transmitted by using the signal conductors connecting the adjacent driving circuits, the length of the signal conductors is shortened so that the stray capacitance is reduced; thus, it becomes possible to provide high-speed operations and also to reduce the power consumption. Moreover, the application of this method makes it possible to eliminate externally added substrates (flexible substrates or printed substrates)

required for placing the common signal conductors and consequently to greatly reduce the substrate area.

FIG. 17 shows one example of the system construction of a display element driving device on the source side in which the method for transmitting signals between the driving circuits as described above is adopted.

In the above-mentioned display driving circuit, not only the source driver starting pulse signal SPI, but also the picture data signals R·G·B having 6 bits respectively, the clock signal CK, the latch signal LS and power-supply-related voltages such as the power supply voltage Vcc, the ground connection electric potential GND, 64 bit gradation displaying voltages Vref 1 to 9 and the liquid crystal panel applying voltage adjustment voltage VLS, are transferred from the first source driver to the second source driver at the next stage by using the inner logics (inner circuits) of the eight source drivers LSI 141 or the inner wiring such as Al lines.

FIG. 18 is a block diagram that shows the circuit construction of the above-mentioned source driver LSI 141. Here, for convenience of explanation, those of the members that have the same functions as the members shown in FIG. 13 are indicated by the same reference numerals and the description thereof is omitted.

On one side of each source driver LSI 141 on the liquid crystal panel side are placed output terminals to the liquid crystal panel, XO 1 to 100, YO 1 to 100 and ZO 1 to 100. Moreover, on one side of each source driver LSI 141 on the controller 102 side are placed input terminals CKin, Rin, Gin, Bin and LSin for the clock signal CK, the picture data signals R·G·B having 6 bits respectively and the latch signal LS, and on one side opposing the controller 102 side are placed output terminals CKout, Rout, Gout, Bout and LSout for the above-mentioned respective signals.

Moreover, in the same manner, input terminals Vref 1 to 9, VLS, Vcc, GND for supplying the power-supply-related voltages such as the 64 bit gradation displaying voltages Vref 1 to 9, the liquid crystal panel applying voltage adjustment voltage VLS, the power supply voltage Vcc and the ground connection electric potential GND and output terminals Vref 1 to 9 out, VLS, Vcc and GND thereof are placed in the same manner as the input-output terminals of the respective signals. The respective power-supply-related voltages are used by connecting the respective voltage wires of Vcc, GND, Vref 1 to 9 and VLS lines to the respective two terminals, that is, the input terminals Vcc, GND, Vref 1 to 9in and VLS as well as the output terminals Vcc, GND, Vref 1 to 9out and VLS, through the inner wiring of the source driver LSI 141.

The above-mentioned input terminals and output terminals are connected by the inner wiring such as the Al line of each source driver LSI 141. FIG. 18 schematically shows a state in which these input terminals CKin, Rin, Gin, Bin, LSin, Vref 1 to 9in, VLS, Vcc and GND are connected to the output terminals CKout, Rout, Gout, Bout, LSout, Vref 1 to 9out, VLS, Vcc and GND by the inner wiring of the source driver LSI 141.

The source driver starting pulse signal SPI is inputted through the input terminal SPin, shifted by the shift register 111 inside the source driver LSI 141 synchronizing to the clock signal CK, and outputted from the output terminal SPout as the source driver starting pulse signal SPO.

The operation of each block of the source driver LSI 141 is carried out in the same manner as the aforementioned source driver LSI 101.

Moreover, FIG. 19 shows one example of the system construction of another source side display element driving device.

In the above-mentioned display element driving device, various signal conductors, which operate at high speeds, are connected between eight source drivers LSI 151, and the power-supply-related voltages are supplied to the respective source drivers LSI 151 in parallel with each other through the common wiring.

The above-mentioned arrangement makes it possible to achieve a low-cost, thin, light-weight, small-size display module such as a liquid display module. However, since this construction allows the inner logics to always operate in all the driving circuits, it fails to solve the problem of an increase in power consumption.

SUMMARY OF THE INVENTION

In a display element having a system construction which satisfies demands for low-cost, thinness, light-weight, small-size devices, that is, is free from an increase in the driving circuit scale, and which is capable of transferring picture data signals by using high-speed clock signals with a shortened wiring length obtained by cascade-connecting driving circuits so that picture data signals can be transmitted by using high-speed clock signals. The objective of the present invention is to provide a low-power-consumption display element driving device and a low-power-consumption display module using such a device that can meet demands for large screen panels.

In order to achieve the above-mentioned objectives, the display element driving device of the present invention is provided with: a plurality of driving circuits that drive a display element based upon picture data signals, and the driving circuit is provided with: a transfer section for shifting and transferring a start pulse signal that is cascade-connected between the driving circuits, synchronizing to a clock signal that is cascade-connected between the driving circuits; a selection section for selecting the picture data signals based upon the output of the transfer section; and a latch section for latching the picture data signals selected by the selection section by using a latch signal, is characterized in that each of the driving circuits is provided with an output control section which, up to the output of the start pulse signal to the driving circuit on the next stage or up to a predetermined time earlier than the output, stops the output of the clock signal to the driving circuit at the next stage.

With the above-mentioned arrangement, the output control section, which is installed in each of the driving circuits, stops the output of the clock signal up to the output of the start pulse signal or up to a predetermined period earlier than the output. In other words, the output control section outputs the clock signal to the driving circuit at the next stage simultaneously with the output of the start pulse signal to the driving circuit at the next stage or in the synchronized timing with a predetermined time earlier than the output. Therefore, no clock signal is inputted to the driving circuits at the next stage and thereafter that are not carrying out the acquiring operation of the picture data signals, with the transfer section, the selection section and the latch section being stopped in their operations.

In general, the cascade connection refers to a connection in which not less than two devices are connected so as to allow the output of one to serve as the input of another following the one. Therefore, when the clock signal and the start pulse signal are respectively cascade-connected between the driving circuits, these signals are successively transferred from one driving circuit to another driving circuit at the next stage connected to the one driving circuit.

As described above, in general, the transfer section, the selection section, the latch section, etc., which constitute a driving circuit, carry out high-speed operations. Therefore, when, in a driving circuit that needs not be operated, its transfer section, selection section, latch section, etc. are unnecessarily operated, there is a great increase in the power consumption.

In contrast, the application of the arrangement of the present invention makes it possible to stop unnecessary operations in the high-speed operating transfer section, selection section, latch section, etc. in the driving circuits that are not carrying out the acquiring operation of the picture data.

Moreover, the clock signal, which is a high-speed operating signal itself, is not inputted to the driving circuits at the next stage and thereafter that need not be operated; therefore, it is not necessary to carry out charging and discharging for stray capacitances resulting from the external wiring placed outside the driving circuits for transmitting the clock signal, the external substrates on which the external wiring is placed, etc.

Thus, it is possible to greatly cut the power consumption required for carrying out high-speed operations in the transfer section, the selection section, the latch section, etc. in the driving circuits that need not be operated as well as the power consumption required for charging and discharging the stray capacitances of the external wiring, etc., and consequently to achieve low power consumption in the display element driving device.

Moreover, at least the above-mentioned clock signal and start pulse signal are allowed to transmit through the driving circuits while being cascade-connected between the driving circuits; therefore, since the clock signal and the start pulse signal are supplied in parallel with the respective driving circuits, no external wiring is required.

This arrangement makes it possible to reduce the number of external wires, thereby achieving miniaturization of the display element driving device. Moreover, the externally attached substrates for placing external wires can be miniaturized or eliminated so that further miniaturization of the display element driving device is achieved.

Furthermore, the display element driving device of the present invention is characterized in that the picture data signals are cascade-connected between the respective driving circuits, and in that the output control section stops the output of the picture data signal to the driving circuit at the next stage up to the output of the start pulse signal to the driving circuit at the next stage or up to a predetermined time earlier than the output With this arrangement, the image data signals are also cascade-connected between the driving circuits in the same manner as the clock signal. Moreover, the output control section controls the output to the driving circuit at the next stage also with respect to the picture data signals. In other words, the output control section stops the output of the picture data signal up to the output of the start pulse signal or up to a predetermined time earlier than the output.

The picture data signals as well as the clock signal are not outputted to the driving circuits at the next stage and thereafter that are not carrying out the acquiring operation of the picture data signals; therefore, it is not necessary to carry out charging and discharging for stray capacitances resulting from the external wiring placed outside the driving circuits, the externally attached substrates on which the external wiring is placed, etc. Moreover, in the driving circuits at the next stage and thereafter, it is possible to cut unnecessary power consumption, for example, required for the operation between the input buffer for the picture data signals and the circuit for temporarily latching the picture image data signals.

Thus, it is possible to greatly cut the power consumption required for carrying out high-speed operations of the driving circuits that need not be operated as well as the power consumption required for charging and discharging the stray capacitances of the external wiring, etc., and consequently to achieve low power consumption in the display element driving device.

Moreover, a display module in accordance with the present invention has a display element driving device that is provided with: a plurality of driving circuits that drive a display element based upon picture data signals, and the driving circuit is provided with: a transfer section for shifting and transferring a start pulse signal that is cascade-connected between the driving circuits, synchronizing to a clock signal that is cascade-connected between the driving circuits; a selection section for selecting the picture data signals based upon the output of the transfer section; and a latch section for latching the picture data signals selected by the selection section by using a latch signal, and that is characterized in that each of the driving circuits is provided with an output control section which, up to the output of the start pulse signal to the driving circuit on the next stage or up to a predetermined time earlier than the output, stops the output of the clock signal to the driving circuit at the next stage, and also has a display element driven by the above-mentioned display element driving device.

Furthermore, another display module in accordance with the present invention has a display element driving device that is provided with: a plurality of driving circuits that drive a display element based upon picture data signals, and the driving circuit is provided with: a transfer section for shifting and transferring a start pulse signal that is cascade-connected between the driving circuits, synchronizing to a clock signal that is cascade-connected between the driving circuits; a selection section for selecting the picture data signals that are cascade-connected between the driving circuits, based upon the output of the transfer section; and a latch section for latching the picture data signals selected by the selection section by using a latch signal, and that is characterized in that each of the driving circuits is provided with an output control section which, up to the output of the start pulse signal to the driving circuit on the next stage or up to a predetermined time earlier than the output, stops the output of the clock signal to the driving circuit at the next stage, and also has a display element driven by the above-mentioned display element driving device.

In the above-mentioned arrangements, the display element driving device, which has achieved a reduction in the power consumption and has been miniaturized, drives the display element in the display module.

Consequently, it is possible to provide a display module which achieves a weight reduction, thinness, miniaturization and low costs.

For a fuller understanding of the nature and advantages of the invention, reference should be made to the ensuing detailed description taken in conjunction with the accompanying drawings.

DESCRIPTION OF THE EMBODIMENTS

Embodiment 1

Referring to FIGS. 1 through 7, the following description will discuss one embodiment of the present invention.

The display element driving device of the present embodiment is constituted by a plurality of source drivers LSI (Large Scale Integrated Circuit) (driving circuit) that are cascade-connected and that drives a liquid crystal panel serving as a liquid crystal display element (display element).

The above-mentioned source drivers LSI are respectively installed on TCPs (Tape Carrier Packages). Here, the TCP refers to a thin package made by affixing the driver LSI to a tape film.

Moreover, the number of pixels in the liquid crystal panel of the present embodiment is represented by 800 pixels×3 (RGB) [source side]×600 pixels [gate side]. Each source driver LSI carries out a displaying operation with 64 gradations. Furthermore, each source driver LSI drives 100 pixels×3 (RGB) so that eight source drivers LSIs installed on the TCPs are required.

Figure 1:
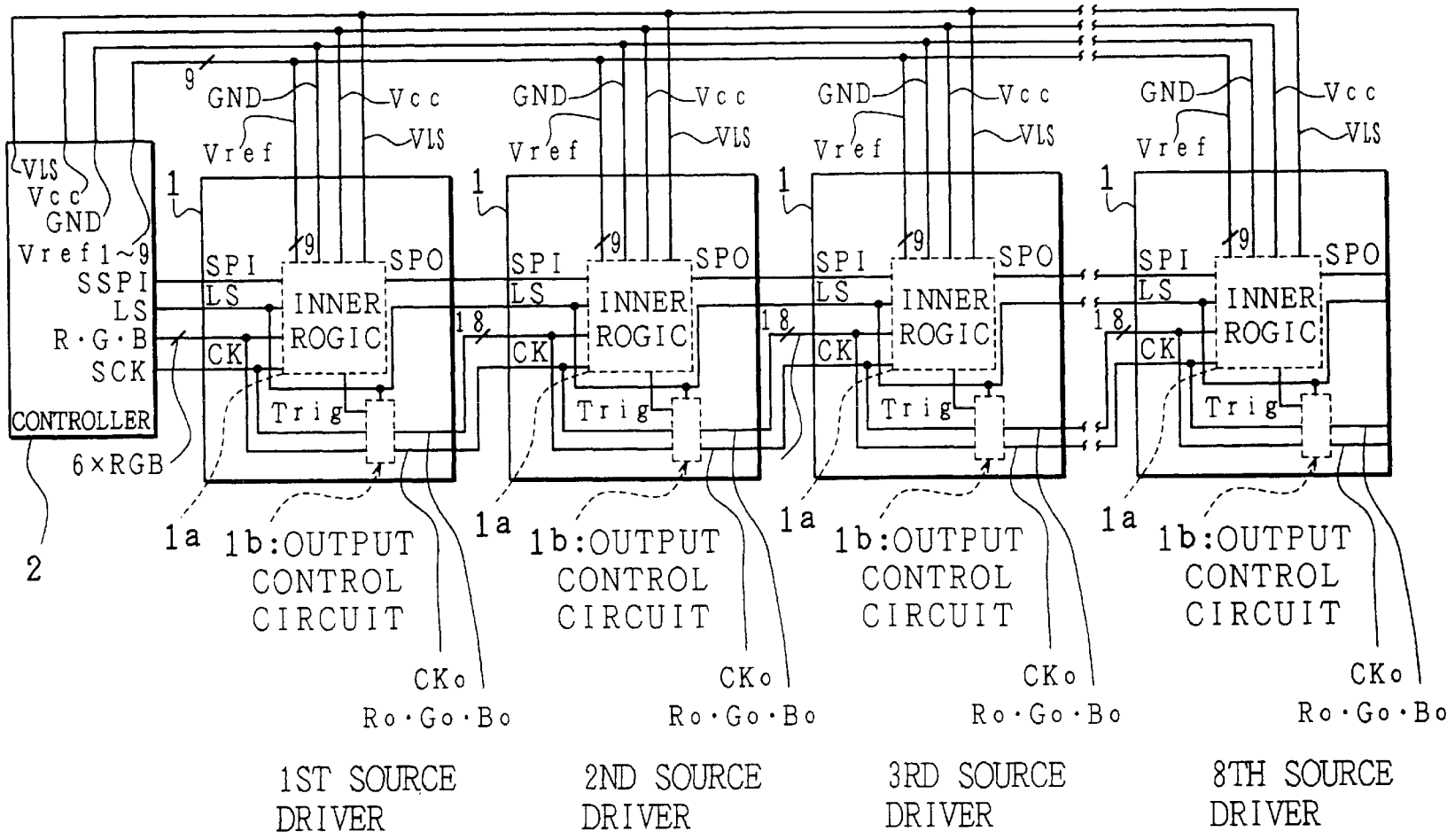
FIG. 1 is an explanatory drawing that shows a system construction of a display element driving device related to the first Embodiment of the present invention.
Figure 2:
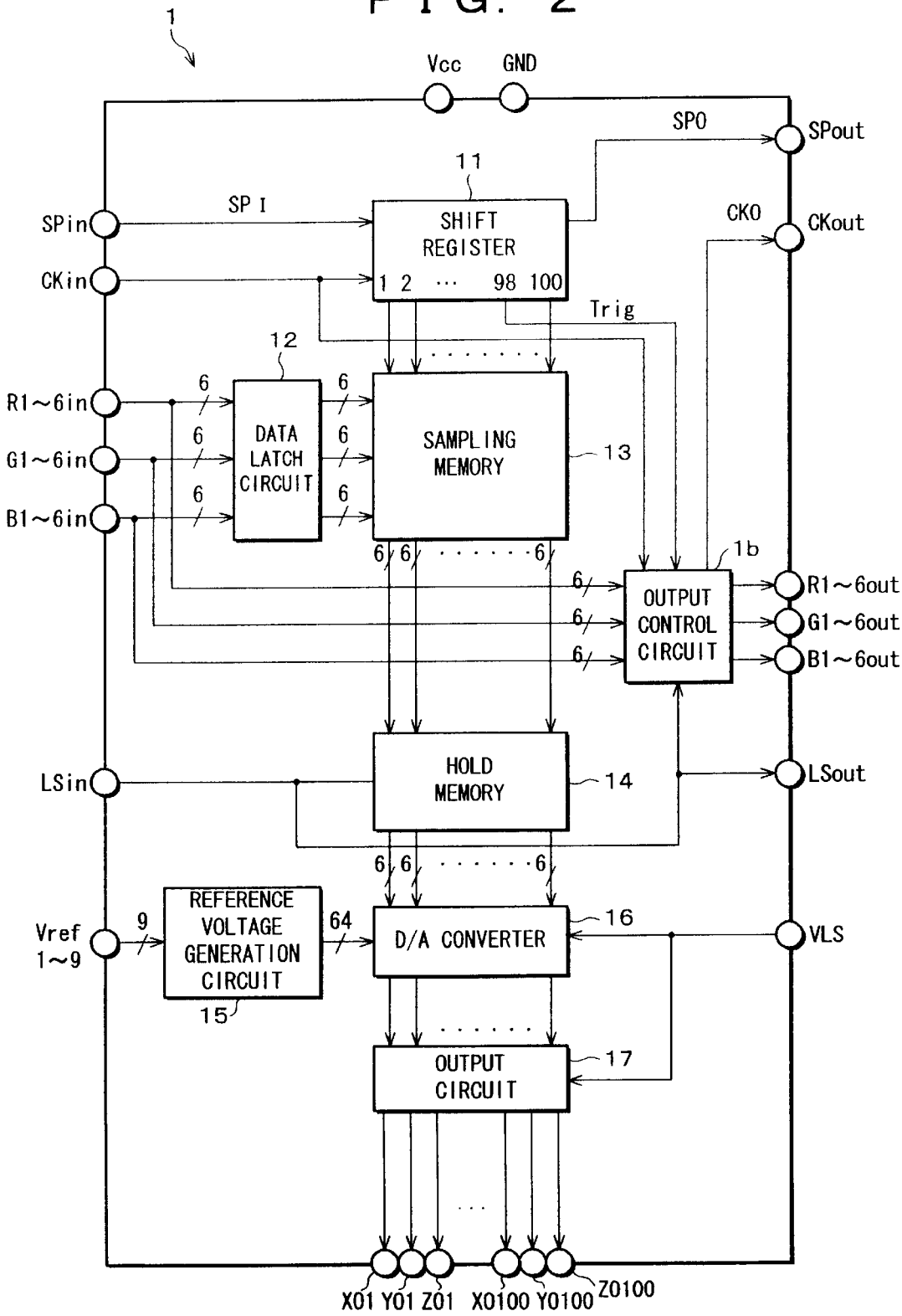
FIG. 2 is a block diagram that shows a construction of a source driver LSI constituting the above-mentioned display element driving device.
Figure 3:
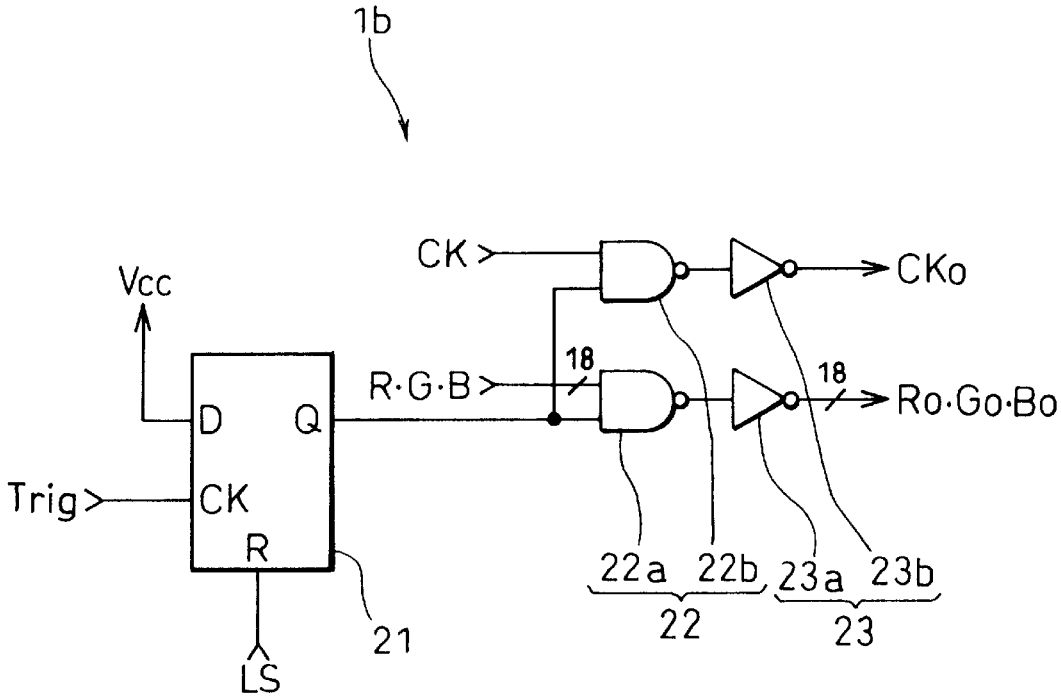
FIG. 3 is a circuit diagram that shows an output control circuit constituting the above-mentioned source driver LSI.

Referring to FIGS. 1 through 3, an explanation will be given of a plurality of source drivers LSIs that constitute a display element driving device of the present embodiment and a connection construction of these source drivers LSI.

Here, the number of pixels of the liquid crystal panel and the construction of the source drivers LSIs, which will be explained here, are examples; and the present invention is not intended to be limited thereby.

As illustrated in FIG. 1, the display element driving device of the present embodiment is provided with eight source drivers LSI 1 serving as source-side driving circuits and a controller 2 which supplies voltages and signals to the eight source drivers LSI 1. With respect to the eight source drivers LSI 1, each pair of adjacent ones are cascade-connected; and in the case when the source drivers LSI 1 have to be mutually distinguished, the source drivers LSI 1 at the respective 1 to 7 stages are referred to as the first to the seventh source drivers, and the source driver LSI 1 at the last stage is referred to as the eighth source driver.

Each source driver LSI 1 is provided with an inner logic 1*a* and an output control circuit (output control means, output control section)1*b*.

The above-mentioned controller 2 is provided with output terminals VLS, Vcc, GND, Vrefs 1 to 9. These output terminals VLS, Vcc, GND, and Vrefs 1 to 9 respectively output a liquid crystal panel applying voltage adjustment voltage VLS, a power supply voltage Vcc, a ground connection electric potential GND, and 64 bit gradation displaying voltages Vref 1 to 9. In this case, the liquid crystal panel applying voltage adjustment voltage VLS, the power supply voltage Vcc, the ground connection electric potential GND, and the 64 bit gradation displaying voltages Vref 1 to 9 are referred to as power-supply-related voltages. These power-supply-related voltages are respectively supplied to the first to the eighth source drivers in parallel with each other through a common wire. Here, the wiring of the power supply voltage Vcc connected to the output control circuit 1*b* and the ground connection electric potential GND are omitted.

Furthermore, the above-mentioned controller 2 has output terminals SSPI, LS, R·G·B, and SCK. These output terminals SSPI, LS, R·G·B, SCK output respective signals, such as a source driver starting pulse signal SPI, a latch signal LS, picture data signals R·G·B, and a clock signal CK. The respective output signals are inputted to the first to eighth source drivers through connection wires for connecting the first to eighth source drivers. In other words, the above-mentioned various signals are cascade-connected between the first to eighth source drivers so that they are successively transmitted to the respective source drivers.

Here, the cascade connection refers to a connection in which one of the outputs of not less than two devices is connected to the device at the succeeding stage so as to form its input. Therefore, in this case, the various signals are cascade-connected between the first to eighth source drivers in such a manner that the various signals are transferred one of the source drivers LSI 1 to the following source driver LSI 1 at the next stage cascade-connected to the former source driver LSI 1.

The following description will discuss, in more detail, the flowing paths of the various signals outputted from the output terminals SSPI, LS, R·G·B and SCK of the controller 2.

The source driver start pulse signal SPI, outputted from the output terminal SSPI of the controller 2, is first inputted to the first source driver. The source driver starting pulse signal SPI inputted to the first source driver is transferred inside the source driver, and outputted as a source driver starting pulse signal SPO. The source driver starting pulse signal SPO is inputted to the second source driver at the next stage as a source driver starting pulse signal SPI.

The picture data signals R·G·B, outputted from the output terminals R·G·B of the controller 2, are first inputted to the first source driver. Each of these picture data signals R·G·B is constituted by 6 bits. The picture data signals R·G·B inputted to the first source driver are inputted to the second source driver at the next stage from the first source driver through the output control circuit 1*b*, which will be described later.

The clock signal CK outputted from the output terminal SCK of the controller 2 is first inputted to the first source driver. The clock signal CK, inputted to the first source driver, is inputted to the second source driver at the next stage from the first source driver through the output control circuit 1*b*, which will be described later.

Thereafter, in the same manner as described above, the source driver starting pulse signal SPI, the picture data signals R·G·B, and the clock signal CK are respectively transferred to the eighth source driver through the connection wires between the first to the eighth source drivers.

Moreover, the latch signal LS, outputted from the output terminal LS of the controller 2, is inputted to the first to eighth source drivers in parallel with each other by using the internal wiring of the first to eighth source drivers and the connection wiring between the first to eighth source drivers.

Additionally, with respect to a Tring signal outputted from the inner logic 1*a* to the output control circuit 1*b*, an explanation will be given later together with the output control circuit 1*b*.

Next, referring to the block diagram of FIG. 2, an explanation will be given of the circuit construction of the internal logic 1*a* and the output control circuit 1*b* of the source drivers LSI 1 that are the first to eighth source drivers.

As illustrated in FIG. 2, the source driver LSI 1 is provided with a shift register (transfer means, transfer section) 11 constituting the internal logic 1*a*, a data latch circuit 12, a sampling memory (selection means, selection section) 13, a hold memory (latch means, latch section) 14, a standard voltage generation circuit 15, a D/A converter 16, an output circuit 17 and an output control circuit lb.

First, the source driver starting pulse signal SPI, which has been outputted from the output terminal SSPI of the controller 2 and inputted to input terminal SPin of the first source driver, is inputted to the shift register 11 of the first source driver. The source driver starting pulse signal SPI is a signal synchronizing to the horizontal synchronizing signal of picture data signals R·G·B, which will be described later.

Moreover, the clock signal CK, which has been outputted from the output terminal SCK of the controller 2 and inputted to the input terminal CKin of the first source driver, is inputted to the shift register 11.

The shift register 11 of the first source driver, which uses the source driver starting pulse signal SPI as a start pulse, shifts and transfers the source driver starting pulse signal SPI in response to a first rise of the clock signal CK that is inputted during a high-level period of the source driver starting pulse signal SPI.

The above-mentioned shift register 11 has 100 stages. The source driver starting pulse signal SPO, which has been shifted to the final stage of the shift register 11 (100 stages in the present embodiment) and outputted from the output terminal SPout of the first source driver, is inputted to the input terminal SP of the second source driver at the next stage as the source driver starting pulse signal SPI.

Thus, the source driver starting pulse signal SPI is shifted to the eighth source driver at the final stage in the same manner.

Here, in the present embodiment, the output of the 98th stage of the shift resister 11 consisting of the 100 stages is taken out as a Trig signal, and this is inputted to the output control circuit 1*b*. In general explanation, among shift registers of m stages, the output from the shift register of (m−x) stage is inputted as the Trig signal to the output control circuit 1*b*, which will be described later (x=0, 1, 2, . . . , m−1). In the present embodiment, with respect to the functions and effects of the Trig signal formed from the 98th stage of the shift register 11 will be described later in detail.

The picture data signals R·G·B, outputted from the output terminals R·G·B, are inputted through the input terminals R1 to sin, G1 to 6in and B1 to 6in of the first source driver. The picture data signals R·G·B thus inputted are inputted to the data latch circuit 12 in parallel with each other. After having been temporarily latched in the data latch circuit 12, the picture data signals R·G·B are sent to the sampling memory 13. Here, the above-mentioned picture data signals R·G·B are color digital video signals consisting of R (Red), G (Green), B (Blue), each having 6 bits (total 18 bits).

The above-mentioned sampling memory 13 samples the picture data signals R·G·B that are sent through the output signals from the respective stages of the shift register 11 in a time divided manner, and stores them until a latch signal LS (outputted from the output terminal LS of the controller 2), which will be described later, is inputted.

The picture data signals R·G·B, stored in the sampling memory 13, are next inputted to the hold memory 14. At the time when data corresponding to one level period of the picture data signals R·G·B has been inputted to the hold memory 14, they are latched by the latch signal LS inputted from the input terminal LSin. Up to the time when picture data signals R·G·B of the next level period have been inputted from the sampling memory 13, the hold memory 14 holds the data of one level period of the picture data signals R·G·B, and then outputs this to the D/A converter 16. At this time, the shift register 11 and the sampling memory 13 carry out a data acquiring process on the picture data signals R·G·B of the next level period.

Based upon reference voltages that are outputted from the output terminals Vref 1 to 9 of the controller 2 and inputted to the input terminals Vref 1 to 9 of the first to eighth source drivers in parallel with each other, the reference voltage generation circuit 15 generates voltages of 64 levels used for gradation display by using, for example, resistance division.

The D/A converter 16 converts the digital picture data signals R·G·B having 6 bits for R, G and B respectively into analog signals. Then, by using the liquid crystal panel applying voltage adjustment voltage VLS outputted from the output terminal VLS of the controller 2 and inputted to the input terminals VLS of the first to eighth source drivers in parallel with each other, the output circuit 17 amplifies the analog signal of 64 levels, and outputs to the input terminals (not shown) of a liquid crystal panel through the output terminals XO 1 to XO 100, YO 1 to YO 100, and ZO 1 to ZO 100.

The above-mentioned output terminals XO 1 to XO 100, YO 1 to YO 100 and ZO 1 to ZO 100 respectively correspond to the picture data signals R·G·B requiring 100 terminals for R·G and B respectively. Here, the input terminal Vcc and the input terminal GND are power supply input terminals for supplying a power supply voltage Vcc and a ground connection electric potential GND.

As described above, the display element driving device of the present embodiment has a system on the source side: in which various signals, such as the clock signal CK, that operate at high speeds are cascade-connected to the first to eighth source drivers and power-supply-related voltages are supplied to the first to eighth source drivers in parallel with each other through common wiring.

In other words, by using the inner wiring made of Al lines (aluminum lines, etc.) installed in the source driver LSI 1, the clock signal CK and the picture data signals R·G·B, which are inputted through the-input terminals CKin, R1 to 6in, G1 to 6in and B1 to 6in of the source driver LSI 1, are outputted from the output terminals CK out, R1 to 6out, G1 to 6out and B1 to 6out after passing through the output control circuit 1*b*, and inputted to the source driver LSI 1 at the next stage.

Moreover, by using the inner wiring made of Al lines (aluminum lines, etc.) installed in the source driver LSI 1, the latch signal LS, which has been inputted from the input terminal LSin of the source driver LSI 1, is inputted to the output control circuit 1*b*, and also outputted from the output terminal LSout and supplied to the source driver LSI 1 at the following stage in parallel with each other.

Next, referring to FIG. 3, an explanation will be given of the output control circuit 1*b* in more detail. The output control circuit 1*b* is constituted by a D-type flipflop (hereinafter, referred to as DF/F) 21, nineteen two-input NAND gates 22 and nineteen inverters 23.

The power supply voltage Vcc is connected to the input terminal D of the above-mentioned DF/F 21, the Trig signal is connected to the input terminal CK, and the latch signal LS is connected to a reset R (which is reset at the Vcc level). The output terminal Q of the DF/F 21 is connected to one of the two input terminals of two-input NAND gate 22.

Since the picture data signals R·G·B have 6 bits for each color, or a total of 18 bits as described above, the picture data signals R·G·B are respectively inputted to the other eighteen input terminals of the two-input NAND gate 22*a* among nineteen two-input NAND gates 22. The outputs of the two-input NAND gates 22*a* are outputted as picture data signals Ro, Go and Bo having 18 bits through the inverter 23*a*.

Here, among nineteen two-input NAND gates, the other input terminal of the rest one two-input NAND gate 22*b* is connected to the input terminal CKin of the clock signal CK. The output of the two-input NAND gate 22*b* to which the clock signal CK is inputted is outputted as a clock signal CKo through the inverter 23*b*.

Figure 4:
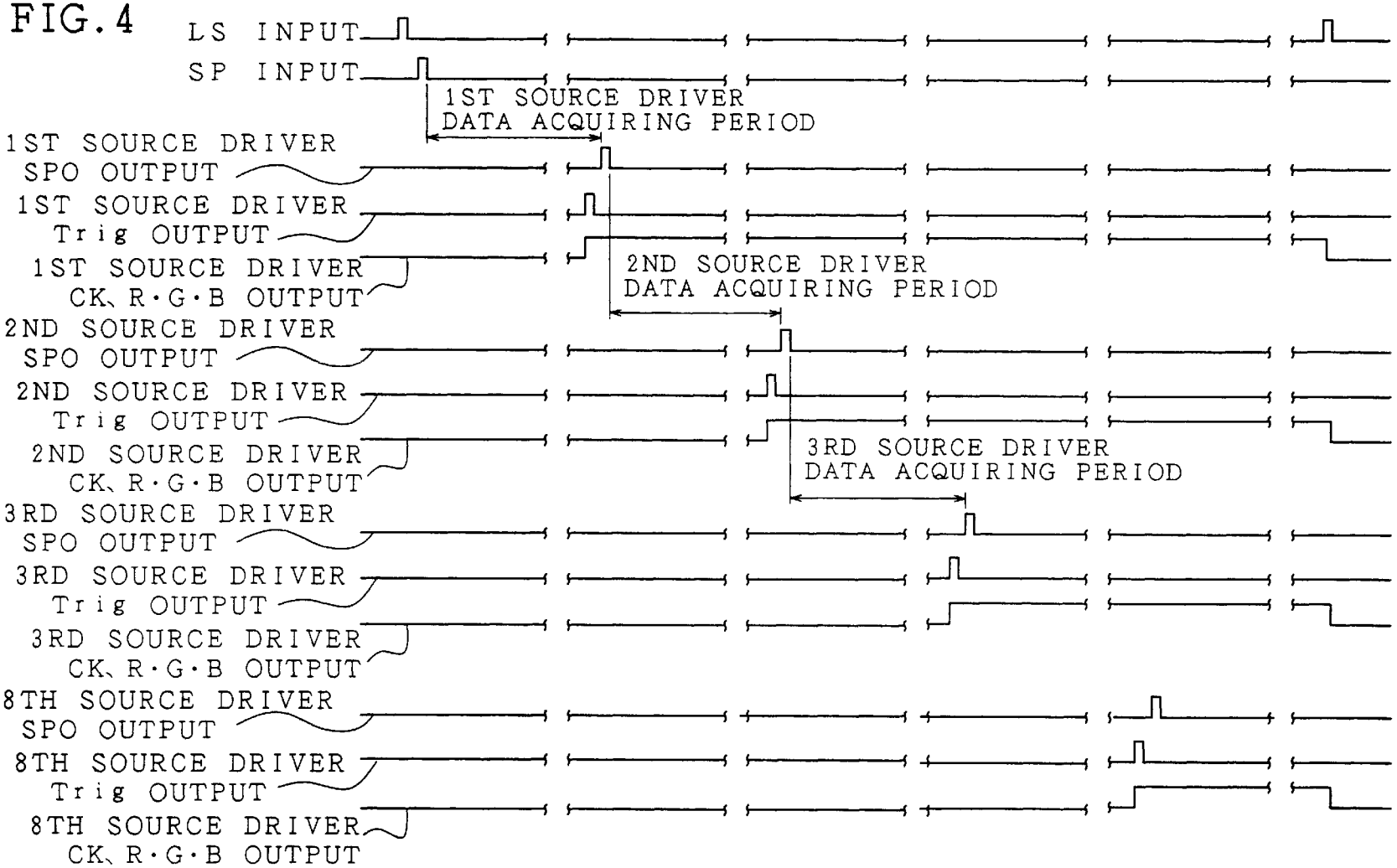
FIG. 4 is a timing chart that shows various signals inputted to the output control circuit.

Referring to FIGS. 3 and 4, an explanation will be given of the system operation of the display element driving device of the present embodiment in which the above-mentioned output control circuit 1*b* is used. FIG. 4 is a timing chart showing respective signals.

When the latch signal LS goes High, the latch signal LS from the input terminal LSin is inputted to all the first to eighth source drivers. This High-level latch signal LS is inputted to the DF/F 21 of the output control circuit 1*b* of the first to eighth source drivers. Since the input of the latch signal LS resets the output control circuit 1*b*, the signal outputted from the output terminal Q of the DF/F 21 goes low. Therefore, both of the picture data signals Ro, Go and Bo and the clock signal CKo outputted from the inverter 23 go low.

After the latch signal LS has gone High, the source driver starting pulse signal SPI is inputted to the first source driver, and transferred through the inner logic 1*a* of shift register 11 with 100 stages, synchronizing to the clock signal CK. The source driver starting pulse signal SPO, outputted from the first source driver, is inputted to the second source driver on the following stage as the source driver starting pulse signal SPI.

Moreover, in the present embodiment, the output from the 98th stage of the shift register 11 as the Trig signal is inputted to the DF/F 21 through the input terminal CK of the DF/F 21 of the output control circuit 1*b*. In response to the rise of the Trig signal, the DF/F 21 outputs the High level (Vcc level) signal inputted from the input terminal D from the output terminal Q.

When the signal which is to be outputted from the output terminal Q to the two-input NAND gate 22 goes high, the gate is opened. Thus, the picture data signals R·G·B of 18 bits and the clock signal CK are outputted to the second source driver at the following stage as the picture data signals Ro·Go·Bo respectively having 18 bits and the clock signal CKo.

As described above, during the period from the time the source driver starting pulse signal SPI has been acquired by the first source driver to the time the picture data signals Ro·Go·Bo and the clock signal CKo are outputted from the first source driver (the first source driver data acquiring period in FIG. 4), the shift register 11, the data latch circuit 12 and the sampling memory 13 in the first source driver carry out the operations as described earlier.

At this time, since the clock signal CK and the picture data signals R·G·B are not inputted to the second to the eighth source drivers, no operations are carried out by the inner logic 1*a* and the output control circuit 1*b*.

The clock signal CKo and the picture data signals Ro.Go.Bo, outputted from the output terminal CKout of the first source driver and the Rout·Gout·Bout, are inputted through the input terminals CKin, Rin·Gin·Bin of the second source driver at the following stage as the clock signal CK and picture data signals R·G·B. At the same time, when the source driver starting pulse signal SPI is acquired by the second source driver, the second source driver also starts operating in the same manner as the first source driver.

In other words, in the same manner as the above-mentioned first source driver, the source driver starting pulse signal SPI, inputted to the second source driver, is transferred by the shift register 11 of 100 stages in the inner logic 1*a*, synchronizing to the clock signal CK (an output from the first source driver). The output from the final stage (100th stage) of the shift register 11 is outputted as the source driver starting pulse signal SPO. The source driver starting pulse signal SPO is inputted to the third source driver at the following stage as the source driver starting pulse signal SPI.

Here, the output from the 98th stage of the shift register 11 in the second source driver is inputted to the input terminal CK of the DF/F21 in the output control circuit 1*b* as a Trig signal. In response to the rise of the Trig signal, the DF/F 21 outputs the High level (Vcc level) signal inputted from the input terminal D through the output terminal Q.

When the signal which is to be outputted from the output terminal Q to the two-input NAND gate 22 goes high, the gate is opened. Thus, the picture data signals R·G·B and the clock signal CK are outputted to the third source driver at the following stage as the picture data signals Ro·Go·Bo and the clock signal CKo.

During the period from the time the source driver starting pulse signal SPI has been acquired by the second source driver to the time the picture data signals Ro·Go·Bo and the clock signal CKo are outputted from the second source driver, the shift register 11, the data latch circuit 12 and the sampling memory 13 in the first and second source drivers carry out the operations, such as image data acquiring, as described earlier.

At this time, since the picture data signals R·G·B and the clock signal CK are not inputted to the second to the eighth source drivers, no operations are carried out by the inner logic 1*a* and the output control circuit 1*b*.

In this manner, the clock signal CK and the picture data signals R·G·B are controlled by the output control circuit 1*b* so that they are not inputted to the next stage and thereafter in which no acquiring operation of the picture data signals R·G·B are being carried out. With this arrangement, it is possible to avoid unnecessary source drivers LSI 1 from being unnecessarily driven, and consequently to cut power consumption greatly.

As described above, the first to the eighth source drivers successively start their operations by acquiring the source driver starting pulse signal SPI, synchronizing to the clock signal CK. In other words, based upon the transferring operation of the source driver starting pulse signal SPI in the shift register 11 of the inner logic 1*a* and the outputs from the respective stages of the shift registers 11 resulting from the source driver starting pulse signal SPI thus transferred, the sampling memory 13 is allowed to acquire the picture data signals R·G·B of 18 bits. Then, finally, all the source drivers LSI 1 up to the eighth source driver at the final stage are allowed to operate.

Figure 5:
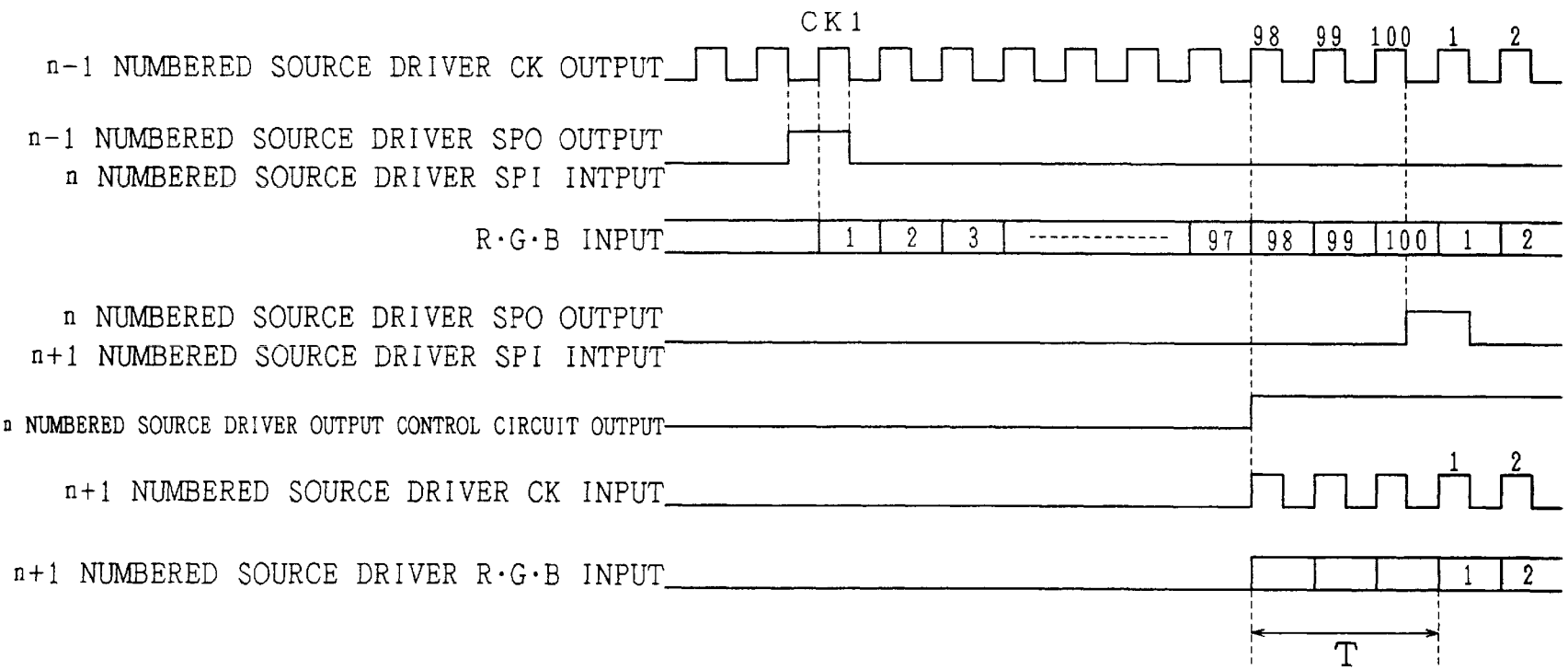
FIG. 5 is a timing chart that shows various signals that are inputted to the adjacent source drivers LSI.

Next, FIG. 5 shows a detailed timing chart indicating respective signal transmissions between adjacent source drivers the first to eighth source drivers.

Next, to the n numbered source driver (n=2, 3, . . . , 7), the source driver starting pulse signal SPO outputted from n−1 numbered source driver at the preceding stage is inputted as the source driver starting pulse signal SPI. After the source driver starting pulse signal SPI has been inputted thereto, the n-numbered source driver, upon receipt of the first clock signal CK (described as CK 1 in FIG. 5) indicating the starting point, is transferred synchronizing to the clock signal CK inside the n-numbered source driver.

Then, based upon the outputs from the respective stages of the shift register 11, the picture data signals R·G·B, inputted to the n-numbered source driver, are inputted to predetermined memory addresses of the sampling memory 13.

The shift register 11 outputs the source driver starting pulse signal SPO as an output from its 100th stage. This signal is inputted to the n+1 numbered source driver at the succeeding stage as the source driver starting pulse signal SPI.

Here, the output from the 98th stage of the shift register 11 in the n-numbered source driver is inputted to the output control circuit 1*b* as a Trig signal. When the signal outputted from the output terminal Q of the DF/F 21 becomes High in accordance with the operation of the output control circuit 1*b* as described above, the n-numbered source driver outputs the clock signal CKo and picture data signals Ro, Go, Bo source driver clock signal CKo and the picture data signals Ro, Go, Bo to the n+1 numbered source driver.

Then, after receipt of the source driver starting pulse signal SPI (the source driver starting pulse signal SPO outputted from the n-numbered source driver), starting with the clock signal CK (denoted as 1 in FIG. 5) that has been first inputted, the n+1 source driver starts to transfer the source driver starting pulse signal SPI, synchronizing to the clock signal CK inside thereof. Then, based upon the outputs from the respective stages of the shift register 11, the picture data signals R·G·B, inputted to the n-numbered source driver, are inputted to predetermined memory addresses of the sampling memory 13.

As described above, in the present embodiment, the output from the 98th stage in the shift register 11 of 100 stages is acquired as the Trig signal. In the case of the aforementioned (m−x) stages, this example is represented by m=100 and x=2.

When, supposing that x=2, a Trig signal is generated, time T as shown in FIG. 5 is obtained. This time T is ensured so that the picture data signals R·G·B and the clock signal CK (in particular, clock signal CK) can be inputted prior to the source driver starting pulse signal SPI. This arrangement allows the n+1 source driver to stably acquire the source driver starting pulse signal SPI.

Additionally, until the next latch signal LS is inputted, the hold memory 14, the D/A converter 16 and the output circuit 17 of the n-numbered source driver continue to output a signal that was latched by the latch signal LS that was inputted one signal before the current signal.

In a state where, after the above-mentioned operations have been carried out, all the picture data signals R·G·B necessary for forming an image corresponding to one level period have been stored in the sampling memory 13 of the eighth source driver at the final stage, the latch signal LS is outputted from the controller 2. Upon receipt of the latch signal LS, the first to the eighth source drivers transfer data stored in the sampling memory 13 to the hold memory 14, and also output the data as a predetermined driving voltage to the liquid crystal panel through the D/A converter 16 and the output circuit 17.

The DF/F21 of the output control circuit 1*b* in each of the first to the eighth source drivers is reset by the latch signal LS so that the picture data signals R·G·B and the clock signal CK currently being outputted are allowed to go Low temporarily. Thereafter, when the next source driver starting pulse signal SPI and clock signal CK are inputted to the first source driver from the controller 20, the above-mentioned operations are successively carried out. By repeating such a sequence of operations 600 times, one screen consisting of 800×600 pixels is displayed.

Additionally, in FIGS. 2 and 3, the input-output buffer circuit is omitted.

Figure 6:
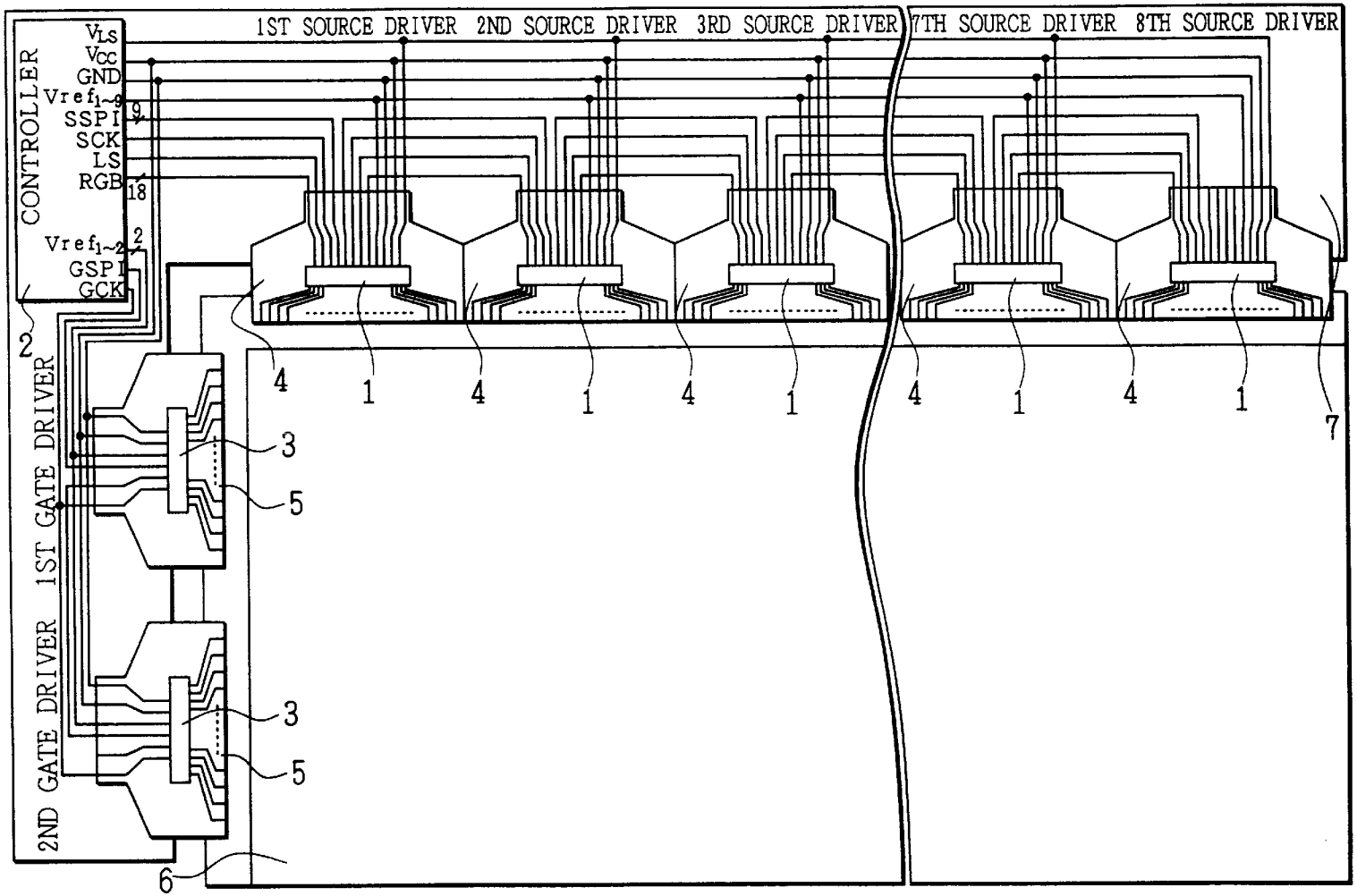
FIG. 6 is a plan view that shows one embodiment of a liquid crystal module in which the above-mentioned display element driving device is used.

Next, FIG. 6 shows a system construction of a liquid crystal display module (display module) in which the first to the eighth source drivers and the system construction of the present embodiment are used.

The above-mentioned liquid crystal display module is constituted by: eight source drivers LSI 1 and two gate drivers LSI 3, serving as a plurality of driving circuits constituting a display driving device of the present embodiment, TCPs 4 and 5 on which the source drivers LSI 1 and the gate drivers LSI 3 are installed, a liquid crystal panel 6 serving as a liquid crystal display element, and a flexible substrate 7 on which a controller 2 is placed. Here, the gate driver LSI 3 drives 300 pixels. Therefore, with respect to the liquid crystal display module of the present embodiment having 600 pixels on the gate side, two of the gate drivers LSI 13 are used.

The output terminal of the source driver LSI 1 is electrically connected to the output terminal of the TCP 4 to the liquid crystal panel 6 through the TCP wiring on the TCP 4. The output terminal of the TCP 4 to the liquid crystal panel 6 and the above-mentioned TCP wiring are thermocompression-bonded to the ITO (Indium Tin Oxide) terminal on the liquid crystal panel 6 through, for example, an ACF (Anisotropic Conductive Film) so that they are electrically connected to the liquid crystal panel 6.

The wiring of the flexible substrate 7 and each TCP wiring are electrically connected to each other by means of, for example, ACF and solder.

The picture data signals R·G·B, the clock signal CK and the latch signal LS, which are supplied to the first to eighth source drivers, are allowed to pass through the respective wires on the flexible substrate 7 from the terminals of the controller 2.

The respective signals, inputted to the first source driver, are outputted from the first source driver, and inputted to the second source driver at the next stage through the wiring on the flexible substrate 7. Thereafter, the respective signals are successively inputted to the. third to eighth source drivers in the same manner.

As explained referring to FIGS. 1 through 3, the source driver starting pulse signal SPI is inputted to the input terminal SPin of the first source driver, and transferred through the shift register 11 of the inner logic 1*a* of the source driver LSI 1. The source driver starting pulse signal SPI, transferred to the final stage of the shift register 11, is outputted to the output terminal SPout as the source driver starting pulse signal SPO.

The source driver starting pulse signal SPO, outputted from the first source driver, is again inputted to the input terminal SPin of the second source driver at the next stage through the wiring of the flexible substrate 7 as the source driver starting pulse signal SPI. Thereafter, the source driver starting pulse signal SPI is transferred through the third to the eighth source drivers in the same manner.

Moreover, in the same manner as described above, the power supply voltage Vcc, the ground connection electric potential GND, the 64 bit gradation displaying voltages Vref 1 to 9 and the liquid crystal panel applying voltage adjustment voltage VLS are commonly supplied to the first through the eighth source drivers from the output terminals, Vcc, GND, Vref 1 to 9 and VLS of the controller 2 through the wiring of the flexible substrate 7.

The gate driver LSI 3 is also installed on the TCP 5 and the TCP wiring is electrically connected to the terminal of the liquid crystal panel 6 and the wiring of the flexible substrate 7 in the same manner as the TCP wiring of the source driver LSI 1.

From the controller 2, the gate driver clock signal GCK (outputted from the output terminal GCK of the controller 2), the power supply voltage Vcc, the ground connection electric potential GND and the liquid crystal panel applying voltage adjustment voltages Vref 1 and 2 (outputted from the terminals Vcc, GND, Vrefs 1 and 2 of the controller) are supplied to the respective gate drivers LSI 3.

Moreover, the gate driver starting pulse signal GSPI (outputted from the output terminal GSPI of the controller) is inputted to the first gate driver. Then the gate driver starting pulse signal GSPI is transferred through the inside of the first. gate driver, synchronizing to the gate driver clock signal GCK, and outputted. The gate driver starting pulse signal GSPI thus outputted is inputted to the second gate driver at the next stage.

The detailed explanation of the operation of the first to the eighth source drivers was given earlier.

Figure 7:
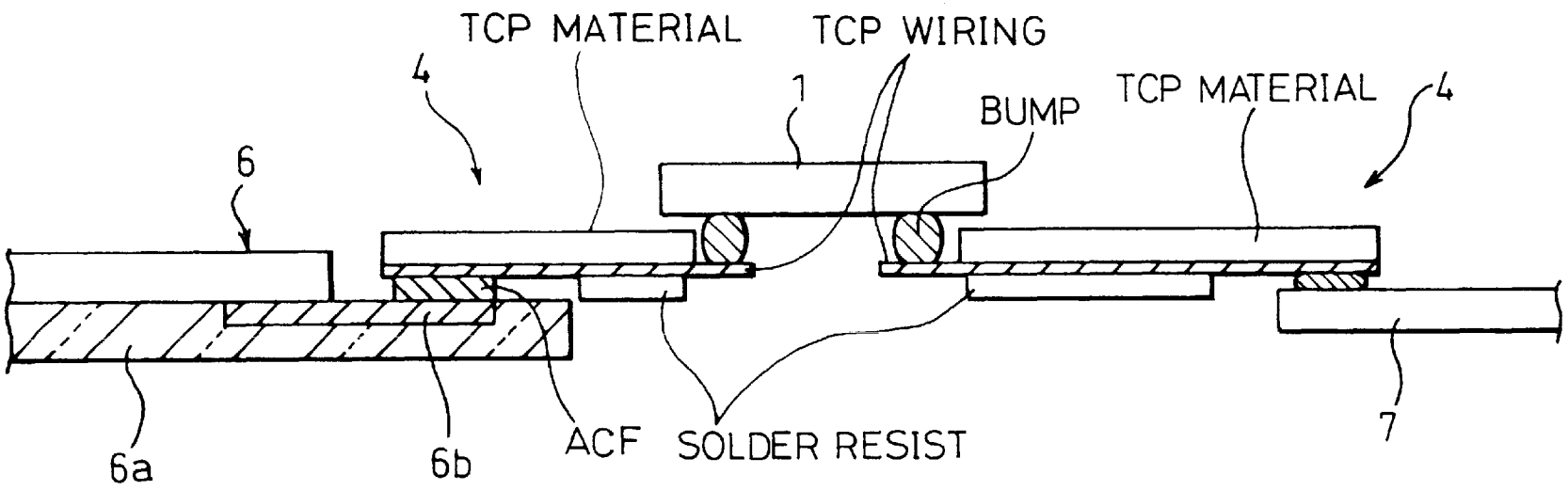
FIG. 7 is a cross-sectional view that shows an installation state of the source driver LSI in the above-mentioned liquid crystal module.

Next, FIG. 7 is a cross-sectional view that shows a state in which the source drivers LSI 1 are installed on the liquid crystal panel 6 and the flexible substrate 7.

A liquid crystal panel side terminal 6*b* placed on the lower side substrate 6*a* of the liquid crystal panel 6 and the TCP wiring on which the source drivers LSI 1 are installed are electrically connected and secured to each other by means of thermocompression bonding through an ACF. The TCP wiring and the TCP wiring section of the flexible substrate 7 are electrically connected and secured to each other through the ACF or soldering. The above-mentioned source drivers LSI 1 are connected to the TCP wiring (inner lead section) through a bump. The other portions except the connecting section on the TCP wiring is protected by solder resist. Here, in FIG. 7, a sealing member for protecting the source drivers LSI 1 is omitted.

As described above, in the present embodiment, the twelve wires of the power-supply-related voltages on the source side (the power supply voltage Vcc, the ground connection electric potential GND, the 64 bit gradation displaying voltages Vref 1 to 9, the liquid crystal panel applying voltage adjustment voltage VLS) are allowed to supply voltages to the first to the first to the eighth source drivers in parallel with each other through the wiring of the flexible substrate 7 that is externally attached substrate.

Moreover 21 signal conductors on the source side (the source driver starting pulse signal SPI, the clock signal CK, the latch signal LS and the picture data signal R·G·B having 6 bits respectively) connect the adjacent first to the eight source drivers through the wiring on the above-mentioned flexible substrate 7. These signal conductors are connected through the wiring on the flexible substrate 7, and since, different from the wiring of the power-supply-related voltages, the wiring length thereof is not so long, the stray capacitance, etc. thereof are small. Therefore, no problem is raised even in the case of high-speed operations of the clock signal CK.

With this arrangement, the signal conductors for high-speed operating signals are connected between the first to eight source drivers so that the influences from the stray capacitance, etc. are reduced to a minimum, and the wiring for the power-supply-related voltage is made by using the external wiring on the flexible substrate 7, etc., so that wiring resistance is reduced.

As described above, in the display element driving device of the present embodiment, the output control circuit 1*b* controls the clock signal CK and the picture data signals R·G·B so as not to be inputted to the source drivers LSI 1 on the next stage and thereafter that are not carrying out the acquiring operation of the picture data signals R·G·B; therefore, it is possible to avoid unnecessary source drivers LSI 1 from being unnecessarily driven. Moreover, the above-mentioned output control circuit 1*b* has an arrangement for determining the output timing of the clock signal CK and the picture data signals R·G·B based upon one output of the outputs of the shift register 11; therefore, it is not necessary to provide a complicated circuit construction. Thus, high-speed operating signal conductors are cascade-connected between the source drivers LSI 1 so as to carry out high-speed processes, and it becomes possible to reduce power consumption to a great degree without increasing the size so much.

Furthermore, the application of the above-mentioned display element driving device makes it possible to achieve a light-weight, thin, small-size, inexpensive liquid crystal display module.

In this case, the signal conductors for supplying the latch signal LS are connected between adjacent the first to the eighth source drivers by installing the input terminals LSin and the output terminals LSout to the first to the eighth source drivers. However, since the above-mentioned latch signal LS has a low speed, another arrangement may be adopted in which, by eliminating the output terminals LS out, it is supplied from the input terminals LSin in parallel with the first to the eighth source drivers in the same manner as the wiring for the power-supply-related voltages.

Moreover, in the first to the eighth source drivers in the present embodiment, both of the clock signal CK and the picture data signals R·G·B are controlled by the output control circuit 1*b*; however, another arrangement may be adopted in which: only the clock signal CK is controlled by the output control circuit 1*b*, and the picture data signals R·G·B, as they are, are outputted from the output terminals Rout·Gout·Bout through the wiring of the first to the eighth source drivers.

In the case of the above-mentioned arrangement, since the picture data signals R·G·B are outputted to the inside of the source drivers LSI 1 that need not be operated, unnecessary capacities of the external substrate, such as the flexible substrate 7, have to be charged and discharged. Therefore, as compared with the arrangement in which both of the clock signal CK and the picture data signals R·G·B are controlled by the output control circuit 1*b*, this arrangement has an increase of unnecessary power consumption. However, since the picture data signals R·G·B of 18 bits need not be transmitted through the output control circuit 1*b*, it is possible to eliminate the circuits of the NAND gate 22*a* and the inverter 23*a* in the output control circuit 1*b*, and consequently to reduce cost.

Embodiment 2

Referring to FIGS. 8 through 11, the following description will discuss the second embodiment of the present invention. Here, for convenience of explanation, those members that have the same functions as those explained in the aforementioned Embodiment 1 are indicated by the same reference numerals, and the description thereof is omitted.

The display element driving device of the present embodiment is virtually the same as the display element driving device of Embodiment 1 except that the source drivers LSI 1 of Embodiment 1 are modified to source drivers LSI (driving circuits) 31.

Figure 8:
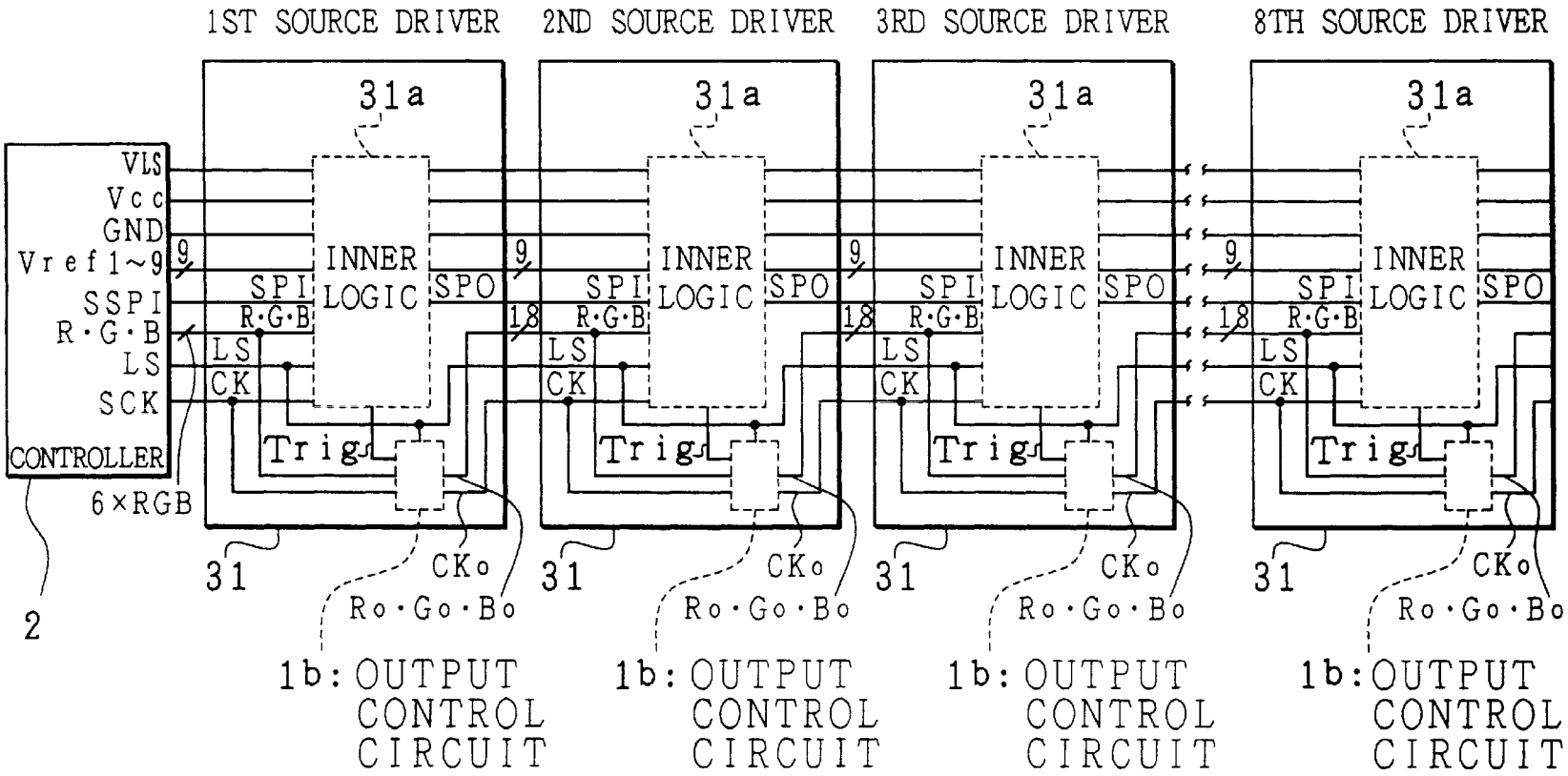
FIG. 8 is an explanatory drawing that shows a system construction of a display element driving device related to the second Embodiment of the present invention.

As illustrated in FIG. 8, the display element driving device of the present embodiment is provided with eight source drivers LSI 31 serving as source-side driving circuits and a controller 2 which supplies voltages and signals to the eight source drivers LSI 31. The eight source drivers LSI 31 are cascade-connected; and in the case when the source drivers LSI 31 have to be mutually distinguished, the source drivers LSI 31 at the respective 1 to 7 stages are referred to as the first to the seventh source drivers, and the source driver LSI 31 at the last stage is referred to as the eighth source driver.

Each source driver LSI 31 is provided with an inner logic 31*a* and an output control circuit (output control means, output control section)1*b*, and the inner logic 31*a* carries out virtually the same operation as the inner logic 1*a* of Embodiment 1.

Figure 9:
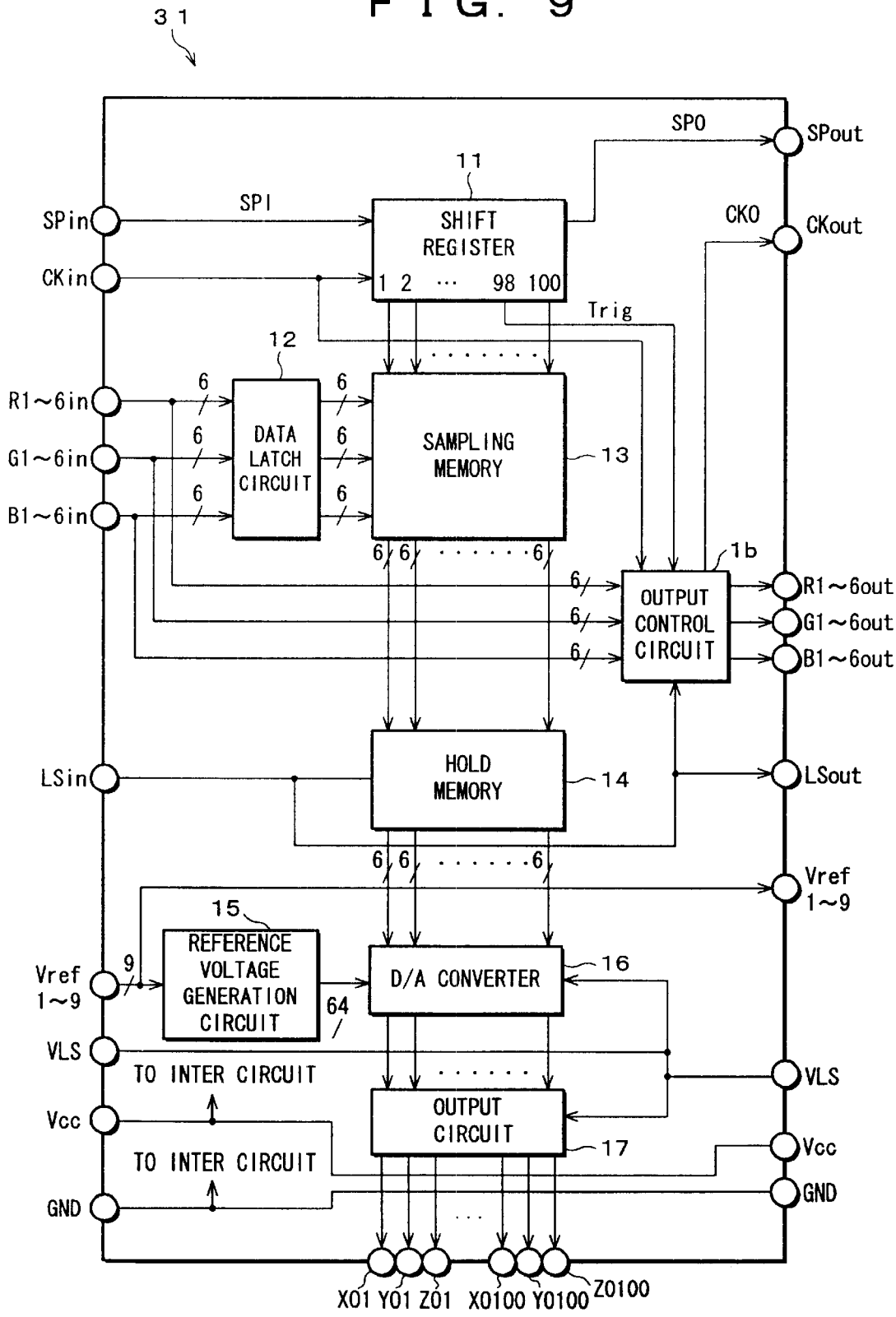
FIG. 9 is a block diagram that shows a construction of a source driver LSI constituting the above-mentioned display element driving device.

FIG. 9 is a block diagram that shows a system construction of the source drivers LSI 31 that constitute the display element driving device in accordance with the present embodiment.

As illustrated in FIGS. 8 and 9, each of the above-mentioned source drivers LSI 31 has an arrangement in which, in addition to the various signal conductors, the wires of the power-supply-related voltages are cascade-connected between the adjacent first to the eighth source drivers by using the inner wiring of the source driver LSI 31, such as Al lines. Here, as illustrated in FIG. 9, the power supply voltage Vcc and the ground connection electric potential GND that are power-supply-related voltages are supplied to the inner circuits of the logic 31*a* and the output control circuit 1*b* respectively. The operations of these power-supply-related voltages are the same as those shown in Embodiment 1; and the description thereof is omitted. Moreover, the wires of the power supply voltage Vcc and the ground connection electric potential GND, connected to the output control circuit 1*b*, are also omitted.

Figure 10:
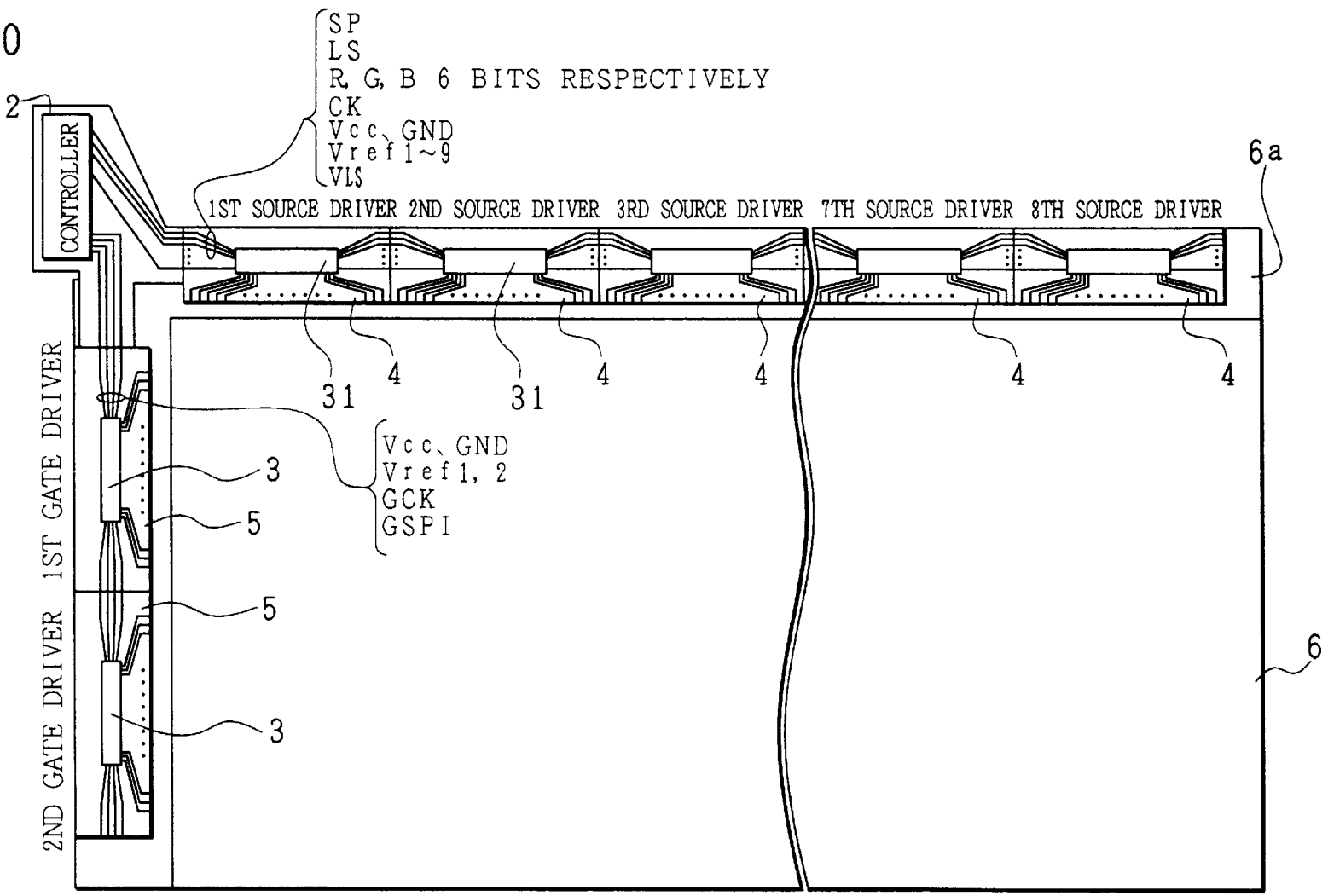
FIG. 10 is a plan view that shows one embodiment of a liquid crystal module in which the above-mentioned display element driving device is used.

Next, FIG. 10 shows the construction of a liquid crystal module of the present embodiment in which the above-mentioned display element driving device is installed. The liquid crystal module of the present embodiment has a modified construction of the liquid crystal module of Embodiment 1 in which the adjacent TCPs 4 are electrically connected and the inner wiring constituted by Al lines etc. placed inside the source driver LSI 31, is utilized so that the various signals and the power-supply-related voltages are transmitted through the inside of the TCPs 4 with the flexible substrate 7 that is an externally attached substrate for supplying external wires being eliminated.

Figure 11:
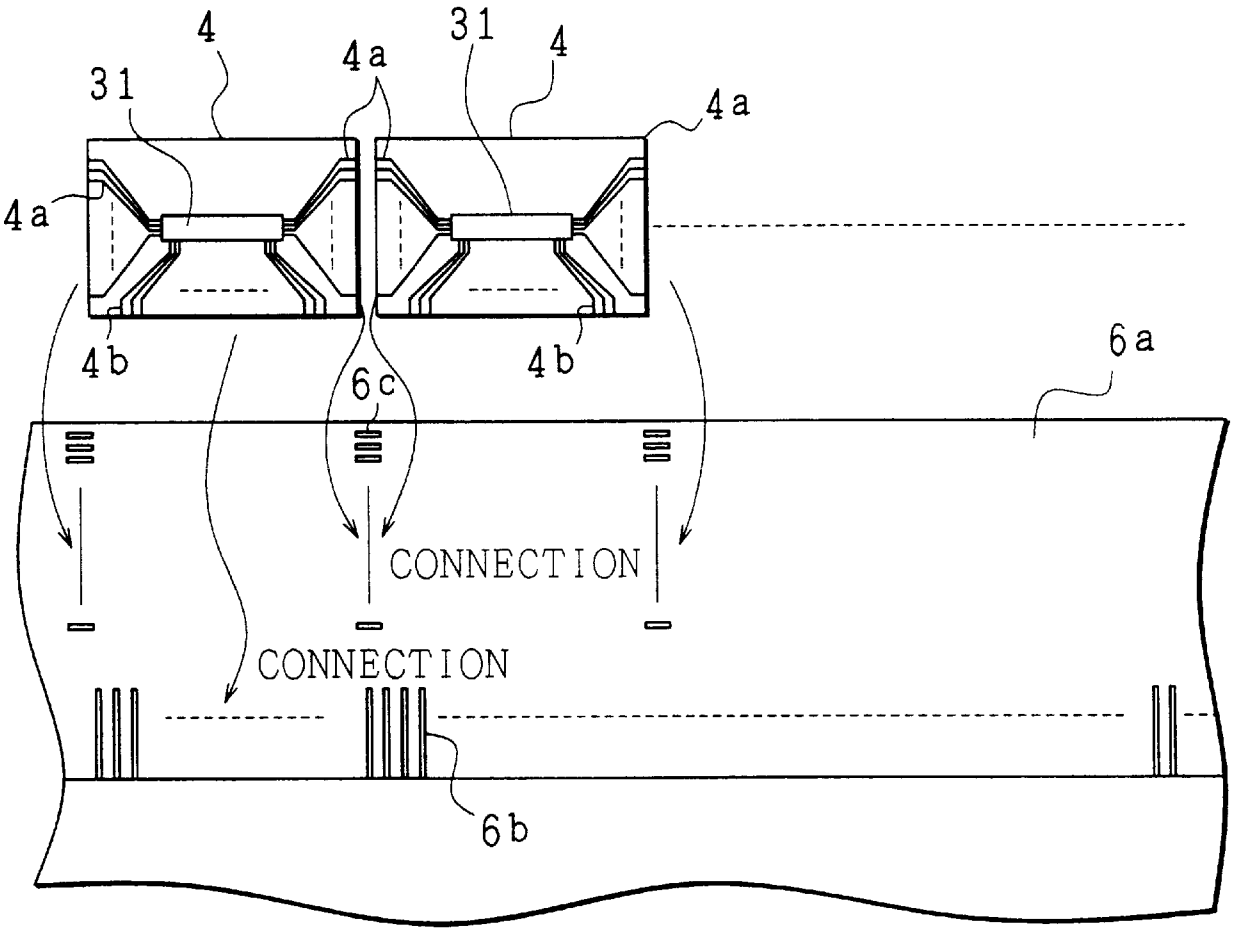
FIG. 11 is a cross-sectional view that shows an installation state of the source driver LSI in the above-mentioned liquid crystal module.
Figure 12:
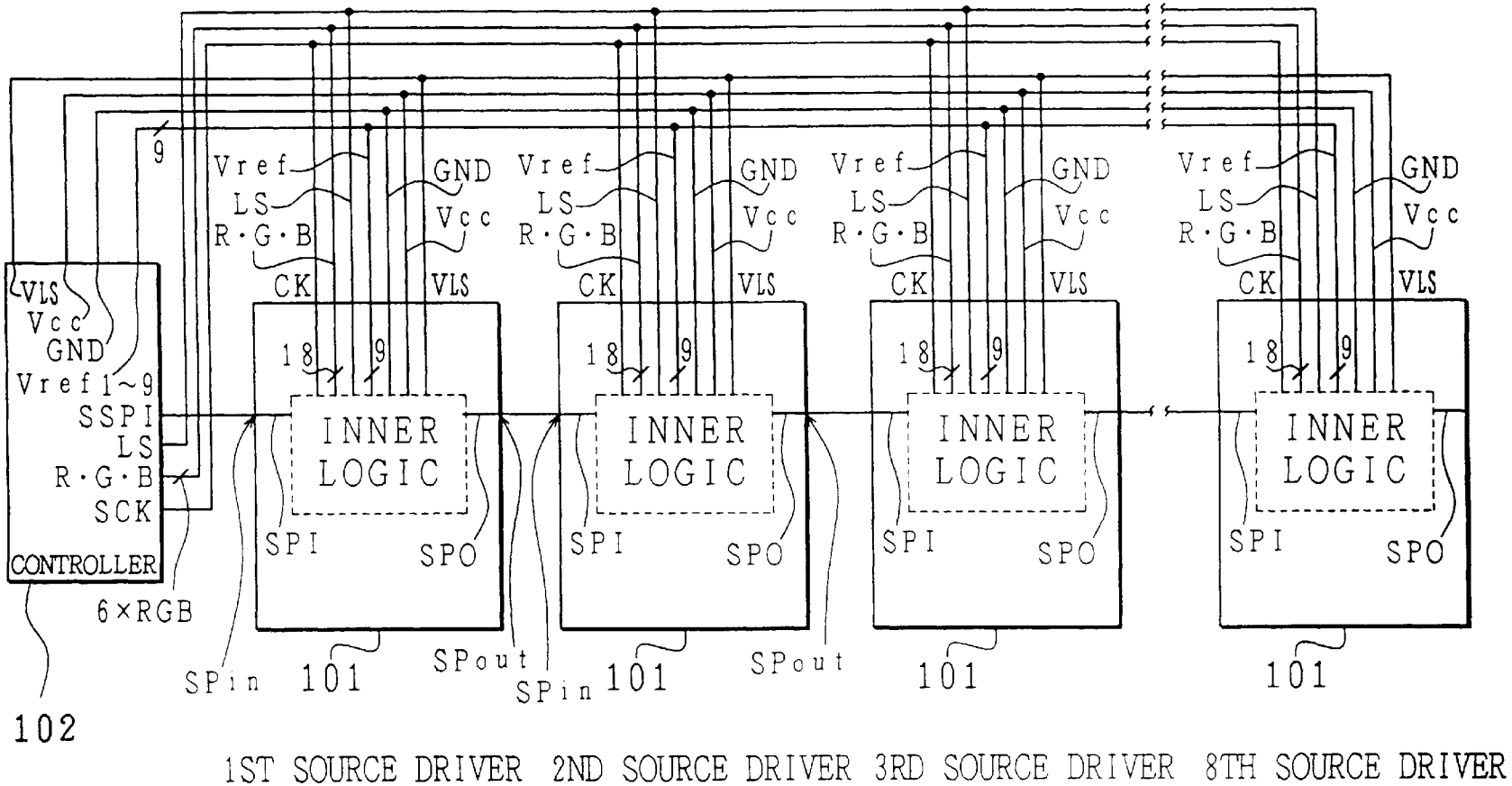
FIG. 12 PRIOR ART
FIG. 12 is an explanatory drawing that shows a system construction of a conventional display element driving device.
Figure 13:
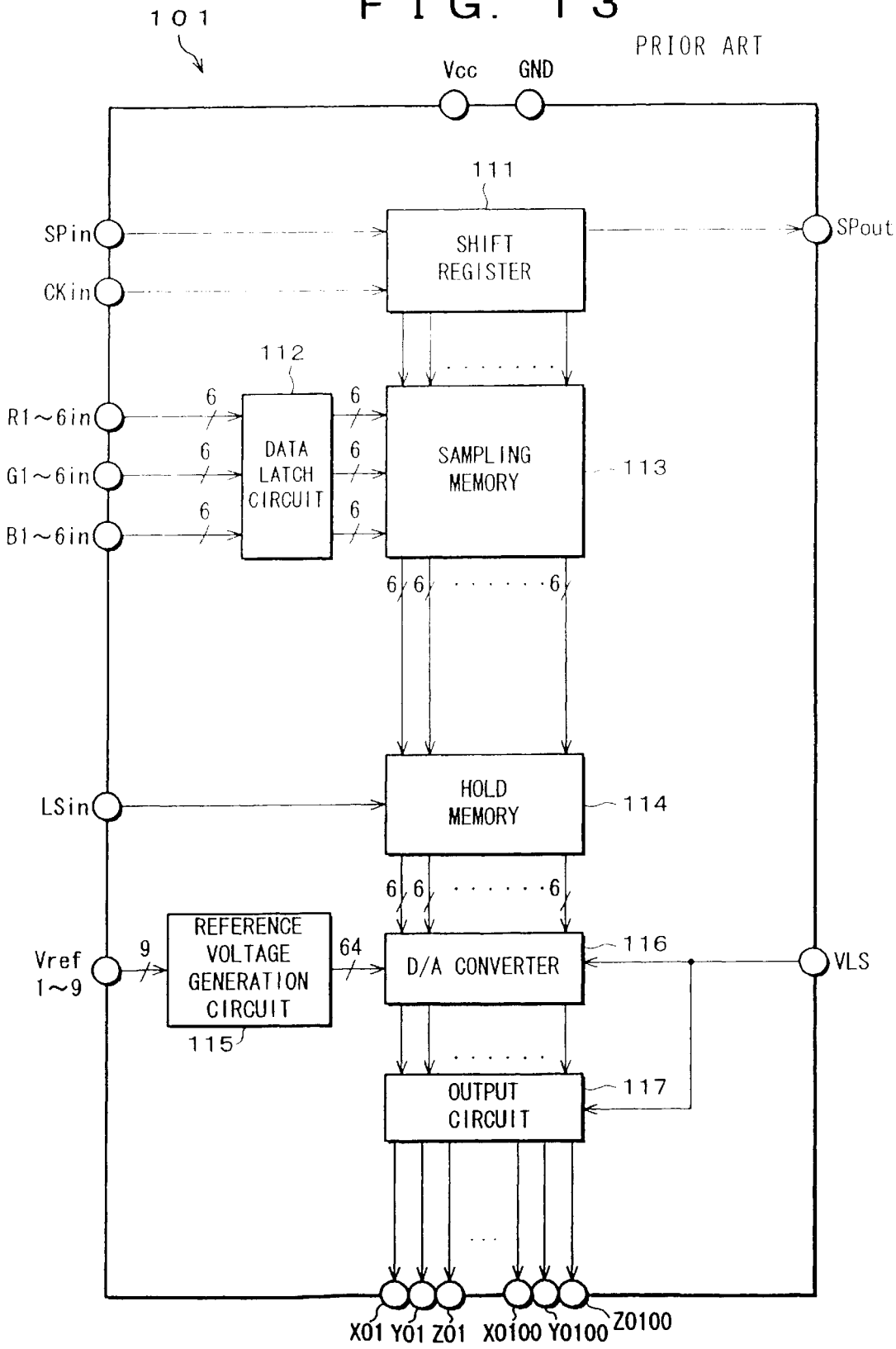
FIG. 13 PRIOR ART
FIG. 13 is a block diagram that shows a construction of a source driver LSI constituting the above-mentioned conventional display element driving device.
Figure 14:
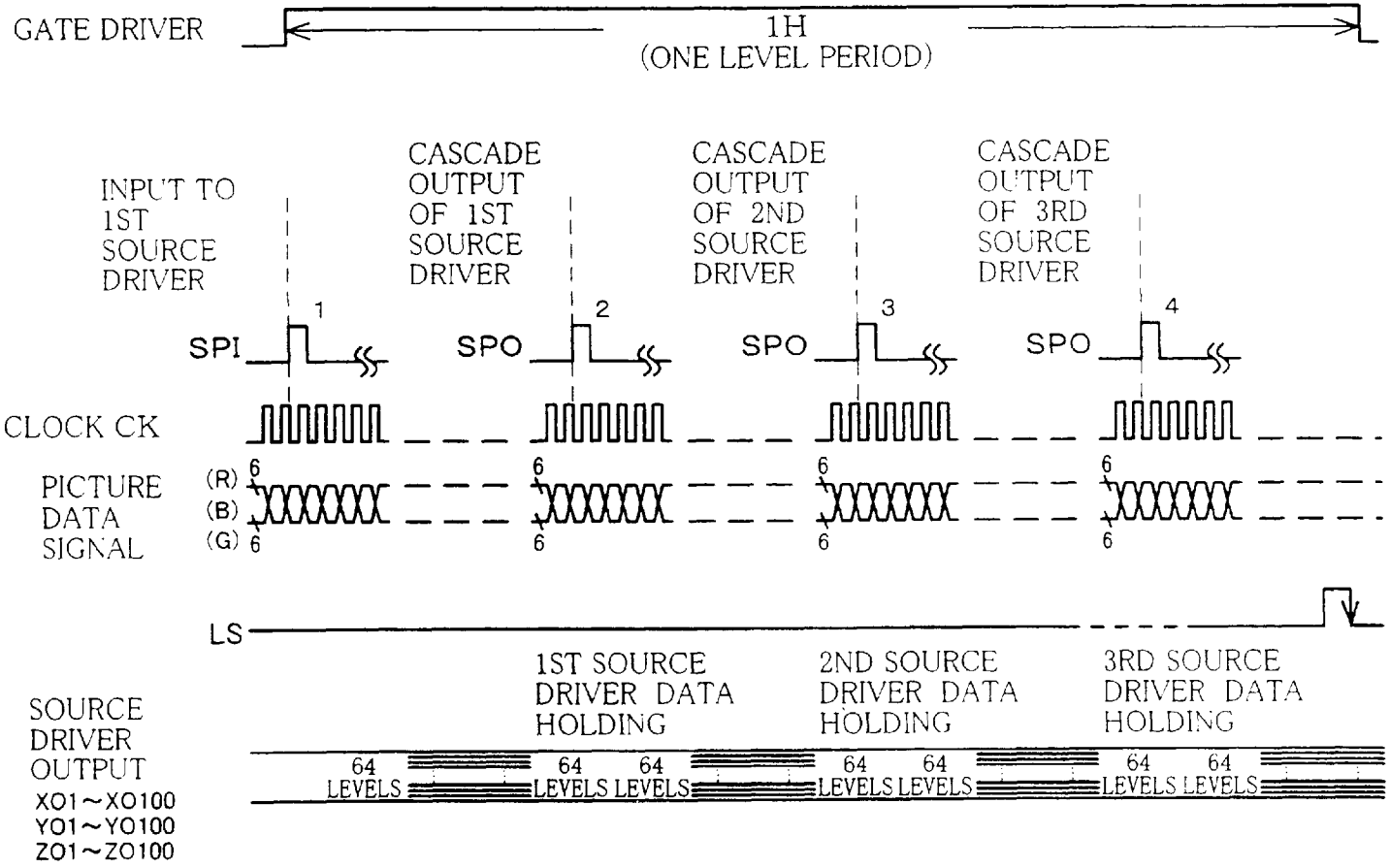
FIG. 14 PRIOR ART
FIG. 14 is a timing chart that shows various signals that are inputted to the above-mentioned source driver LSI.
Figure 15:
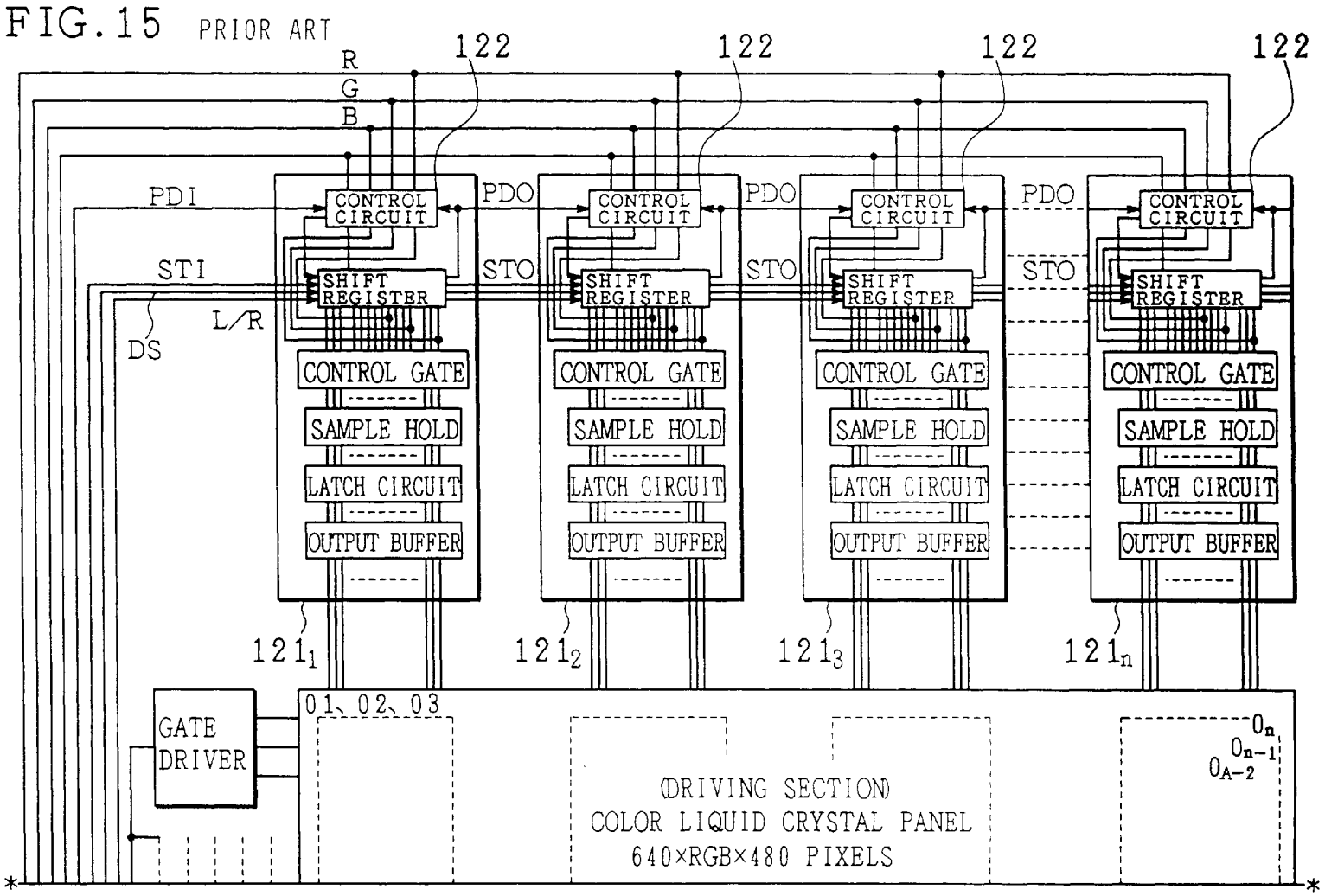
FIG.15 PRIOR ART
FIG. 15 is a block diagram that shows a construction of a conventional display element driving device disclosed in Japanese Laid-Open Patent Application No. 72992/1993 (Tokukaihei 5-72992).
Figure 16:
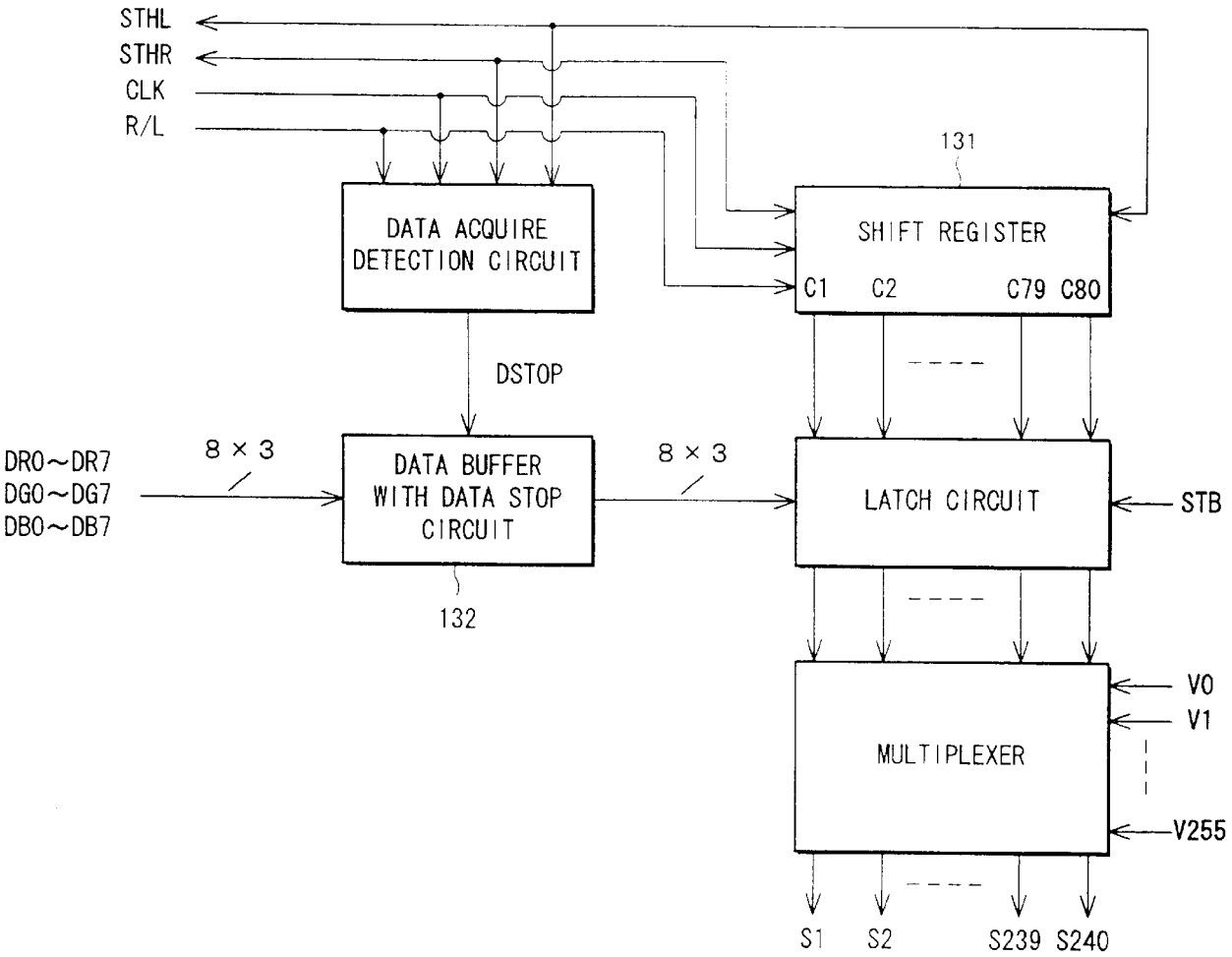
FIG. 16 PRIOR ART
FIG. 16 is a block diagram that shows a construction of a conventional display element driving device disclosed in Japanese Laid-Open Patent Application No. 1997/68949 (Tokukaihei 9-68949).
Figure 17:
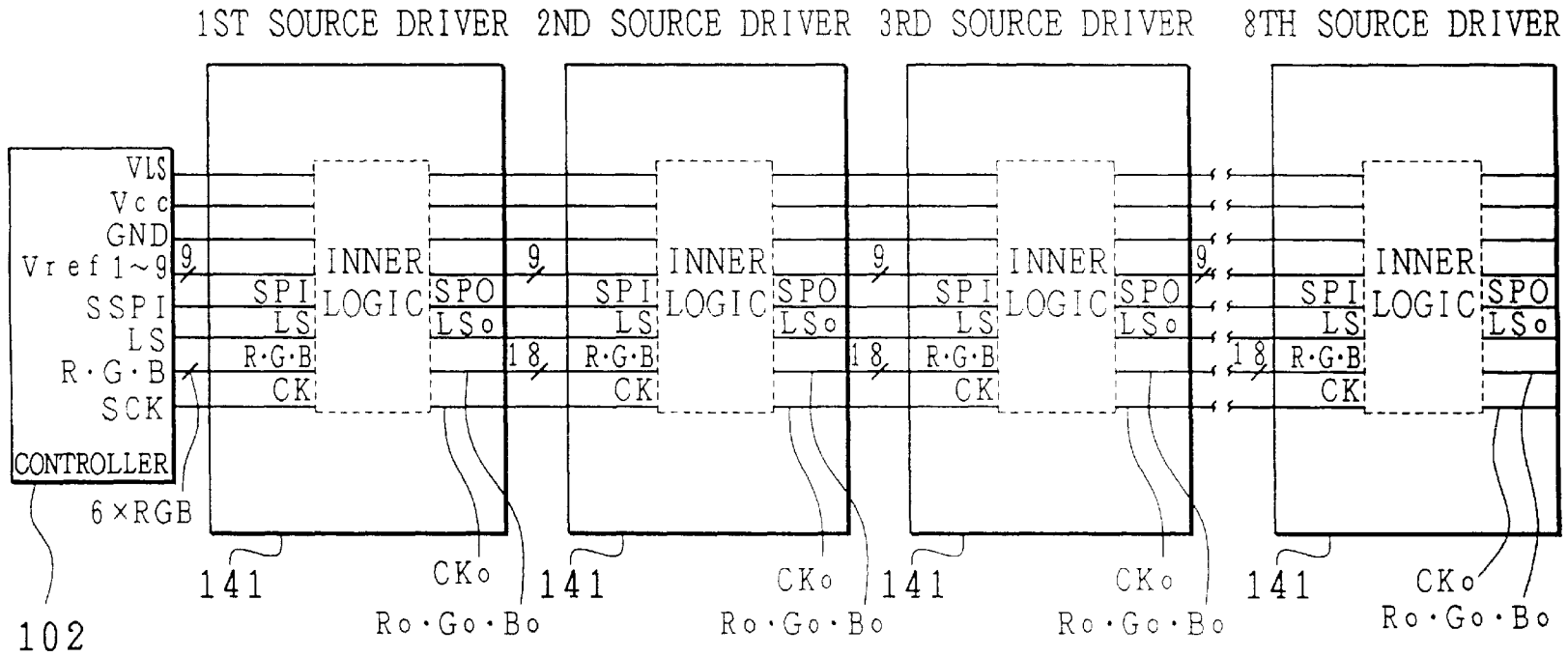
FIG. 17 PRIOR ART
FIG. 17 is an explanatory drawing that shows a system construction of another conventional display element driving device.
Figure 18:
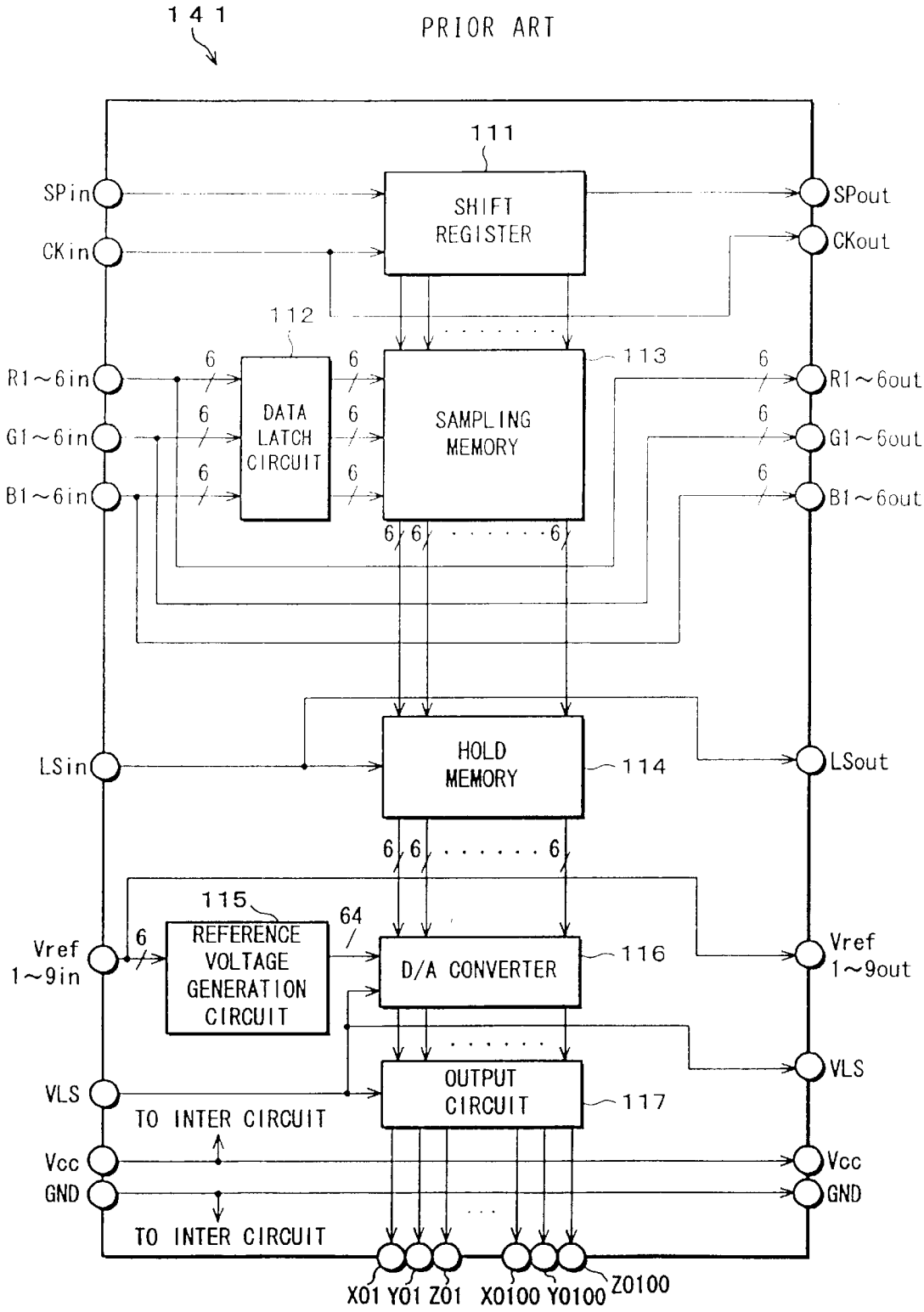
FIG. 18 PRIOR ART
FIG. 18 is a block diagram that shows a construction of a source driver LSI constituting the above-mentioned conventional display element driving device.
Figure 19:
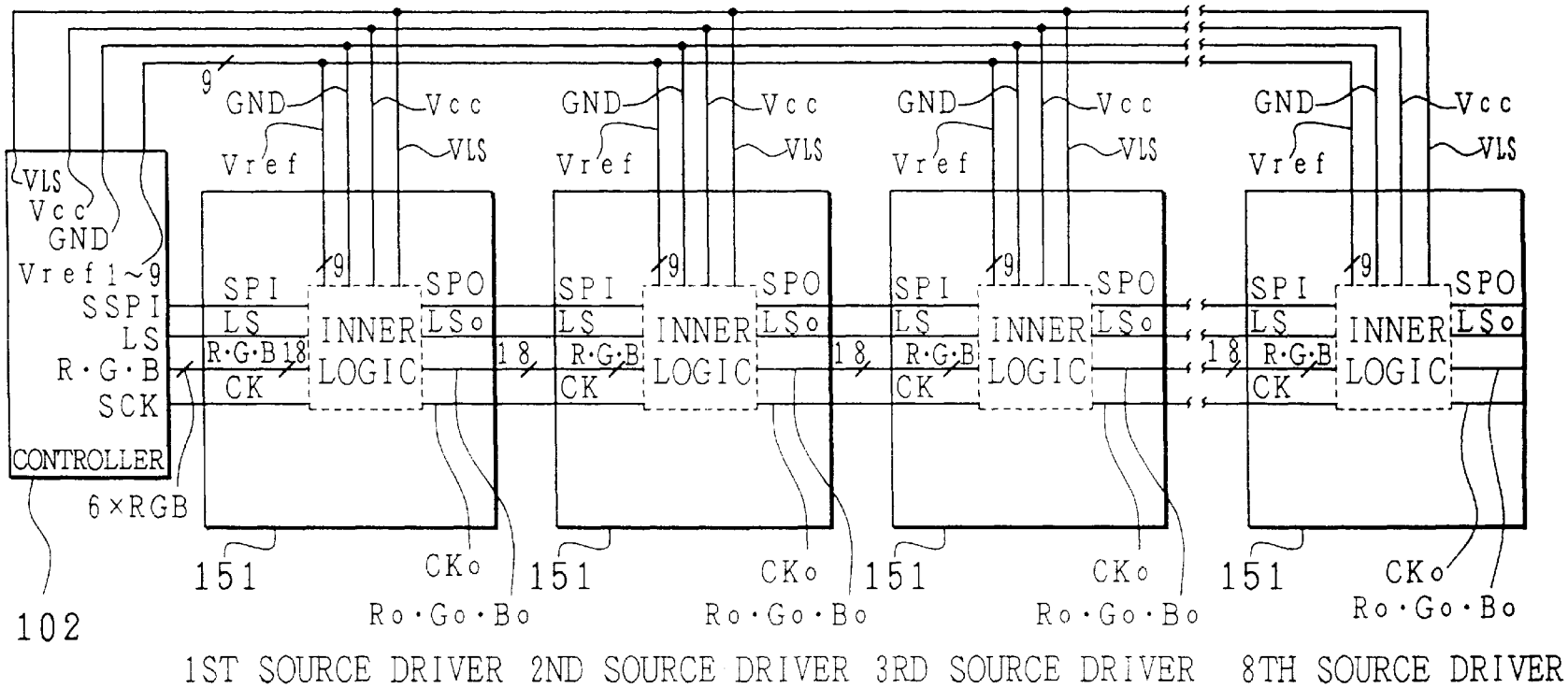
FIG.19 PRIOR ART
FIG. 19 is an explanatory drawing that shows a system construction of still another conventional display element driving device.

FIG. 11 shows a state in which the TCPs 4, each having the above-mentioned source driver LSI 31, are connected to the liquid crystal panel 6.

In the same manner as the source driver LSI 1 of Embodiment 1, the source driver LSI 31 is installed on the TCP 4. Each of TCP wires 4*a*, placed on the side face of each TCP 4, and a connection wire (ITO wiring) 6*c* of the lower side substrate 6*a* are connected so that the TCP wires 4*a* of the adjacent TCPs 4 are electrically connected through the connection wire 6*c*. This connection is achieved by means of thermocompression bonding carried out through the same ACF, simultaneously as the TCP output terminal 4*b* and the liquid crystal panel side terminal 6*b*.

The application of this construction makes it possible to eliminate the flexible substrate 7 for supplying the external wiring for the various signal conductors and power-supply-related voltages. The controller 2 is installed on a flexible substrate, not shown, in a separate manner, and the installation is carried out by connecting it to a connection wire 6*c* of the liquid crystal panel 6 in the same manner as described earlier.

Consequently, in addition to a great reduction in power consumption, the display element driving device of the present embodiment makes it possible to achieve a weight reduction, miniaturization and low costs.

Moreover, the liquid crystal display module of the present embodiment, which uses the above-mentioned display element driving device capable of achieving a reduction in power consumption, thinness, a weight reduction, miniaturization and low costs, also achieves a reduction in power consumption, thinness, a weight reduction, miniaturization and low costs by utilizing the features of the device.

As described above, in the present embodiment, the adjacent TCPs 4 are connected by using the connection wiring 6*c* of the liquid crystal panel 6; however, another method may be adopted in which, instead of using the wiring on the liquid crystal panel, the adjacent T6P wires are overlapped with each other and connected. This method has been disclosed in Japanese Laid-Open Patent Application No. 297394/1993 (Tokukaihei 5-297394) filed by the applicant of the present application, Japanese Laid-Open Patent Application No. 3684/1994 (Tokukaihei 6-3684) and Japanese Laid-Open Patent Application No. 214858/1998 (Tokukaihei 10-214858), etc.

Since such a construction also eliminates the external substrate for wiring (the flexible substrate 7 or the print substrate), it is possible to achieve low costs and miniaturization of the liquid crystal module.

As described above, the display element driving device of the present invention is constituted by a plurality of driving circuits that are cascade-connected and that drive a display element based upon picture data signals, and the driving circuit is provided with: a transfer section for sifting and transferring a start pulse signal, synchronizing to a clock signal; a selection section for selecting the picture data signals based upon the output of the transfer section; and a latch section for latching the picture data signals selected by the selection section by using a latch signal, wherein at least the clock signal and the start pulse signal are cascade-connected between the driving circuits, is characterized in that each of the driving circuits is provided with an output control section which, up to the output of the start pulse signal to the driving. circuit on the next stage or up to a predetermined time earlier than the output, stops the output of the clock signal to the driving circuit at the next stage.

With the above-mentioned arrangement, the output control section, which is installed in each of the driving circuits that are cascade-connected, stops the output of the clock signal up to the output of the start pulse signal or up to a predetermined period earlier than the output. In other words, the output control section outputs the clock signal to the driving circuit at the next stage simultaneously with the output of the start pulse signal to the driving circuit at the next stage or in the synchronized timing with a predetermined time earlier than the output. Therefore, no clock signal is inputted to the driving circuits at the next stage and thereafter that are not carrying out the acquiring operation of the picture data signals, with the transfer section, the selection section and the latch section being stopped in their operations.

As described above, in general, the transfer section, the selection section, the latch section, etc., which constitute a driving circuit, carry out high-speed operations. Therefore, when, in a driving circuit that needs not be operated, its transfer section, selection section, latch section, etc. are unnecessarily operated, there is a great increase in the power consumption.

In contrast, the application of the arrangement of the present invention makes it possible to stop unnecessary operations in the high-speed operating transfer section, selection section, latch section, etc. in the driving circuits that are not carrying out the acquiring operation of the picture data.

Moreover, the clock signal, which is a high-speed operating signal itself, is not inputted to the driving circuits at the next stage and thereafter that need not be operated; therefore, it is not necessary to carry out charging and discharging for stray capacitances resulting from the external wiring placed outside the driving circuits for transmitting the clock signal, the external substrates on which the external wiring is placed, etc.

Thus, it is possible to greatly cut the power consumption required for carrying out high-speed operations in the transfer section, the selection section, the latch section, etc. in the driving circuits that need not be operated as well as the power consumption required for charging and discharging the stray capacitances of the external wiring, etc., and consequently to achieve low power consumption in the display element driving device.

Moreover, at least the above-mentioned clock signal and start pulse signal are allowed to transmit through the driving circuits while being cascade-connected between the driving circuits; therefore, since the clock signal and the start pulse signal are supplied in parallel with the respective driving circuits, no external wiring is required.

This arrangement makes it possible to reduce the number of external wires, thereby achieving miniaturization of the display element driving device. Moreover, the externally attached substrates for placing external wires can be miniaturized or eliminated so that further miniaturization of the display element driving device is achieved.

Furthermore, the display element driving device of the present invention is characterized in that the picture data signals are cascade-connected between the respective driving circuits, and in that the output control section stops the output of the picture data signal to the driving circuit at the next stage up to the output of the start pulse signal to the driving circuit at the next stage or up to a predetermined time earlier than the output With this arrangement, the image data signals are also cascade-connected between the driving circuits in the same manner as the clock signal. Moreover, the output control section controls the output to the driving circuit at the next stage also with respect to the picture data signals. In other words, the output control section stops the output of the picture data signal up to the output of the start pulse signal or up to a predetermined time earlier than the output.

The picture data signals as well as the clock signal are not outputted to the driving circuits at the next stage and thereafter that are not carrying out the acquiring operation of the picture data signals; therefore, it is not necessary to carry out charging and discharging for stray capacitances resulting from the external wiring placed outside the driving circuits, the externally attached substrates on which the external wiring is placed, etc. Moreover, in the driving circuits at the next stage and thereafter, it is possible to cut unnecessary power consumption, for example, required for the operation between the input buffer for the picture data signals and the circuit for temporarily latching the picture image data signals.

Thus, it is possible to greatly cut the power consumption required for carrying out high-speed operations of the driving circuits that need not be operated as well as the power consumption required for charging and discharging the stray capacitances of the external wiring, etc., and consequently to achieve low power consumption in the display element driving device.

Moreover, in addition to the clock signal and the start pulse signal, the picture data signals are also cascade-connected between the driving circuits; therefore, it is possible to eliminate the external wiring that serves as common wiring for supplying the picture data signals to the driving circuits in parallel with each other.

This arrangement makes it possible to reduce the number of external wires, thereby achieving miniaturization of the display element driving device. Moreover, the externally attached substrates for placing external wires can be miniaturized or eliminated so that further miniaturization of the display element driving device is achieved.

Moreover, the display element driving device of the present invention is characterized in that the output control section outputs the clock signal to the driving circuit at the next stage based upon one of the outputs of the transfer section.

In the above-mentioned arrangement, the output control section determines the timing of the output of the clock signal based upon one of the outputs of the transfer section. Therefore, it is not necessary to provide a complex construction, and the output control section can be constructed by using an additional circuit with a simple structure.

With this arrangement, it is possible to cut the power consumption of the output control section without a great increase in the size of the driving circuits, without causing high costs.

Moreover, the display element driving device of the present invention is characterized in that the output control section outputs the clock signal or the clock signal and the picture data signal to the driving circuit at the next stage based upon one of the outputs of the transfer section.

In the above-mentioned arrangement, the output control section determines the output timing of the clock signal or the clock signal and the picture data signals, based upon one of the outputs of the transfer section.

With this arrangement, it is possible to cut the power consumption of the output control section without a great increase in the size of the driving circuits, without causing high costs.

Moreover, the display module of the present invention is characterized by including the above-mentioned display element driving device and a display element driven by the display element driving device.

In the above-mentioned arrangement, the display element driving device, which has achieved a reduction in the power consumption and has been miniaturized, drives the display element in the display module.

Consequently, it is possible to provide a display module which achieves a weight reduction, thinness, miniaturization and low costs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display element driving device comprising:

a plurality of driving circuits that drive a display element based upon picture data signals, the driving circuit being provided with:

transfer means for shifting and transferring a start pulse signal that is cascade-connected between the driving circuits, synchronizing to a clock signal that is cascade-connected between the driving circuits;

selection means for selecting the picture data signals based upon the output of the transfer means; and latch means for latching the picture data signals selected by the selection means by using a latch signal, wherein each of the driving circuits is provided with an output control means which, up to the output of the start pulse signal to the driving circuit on the next stage or up to a predetermined time earlier than the output, stops the output of the clock signal to the driving circuit at the next stage.

2. The display element driving device as defined in claim 1, wherein power-supply-related voltages are supplied to the respective driving circuits by utilizing wiring that is cascade-connected between the driving circuits.

3. The display element driving device as defined in claim 1, wherein the output control means outputs the clock signal to the driving circuit at the next stage based upon one of the outputs of the transfer means.

4. The display element driving device as defined in claim 3, wherein:

the output control means outputs the clock signal to the driving circuit at the next stage based on one of the outputs of the transfer means, so as to stop the output of the clock signal to the driving circuit at the next stage up to the predetermined time, where the one of the outputs of the transfer means is earlier than a last output of the transfer means.

5. The display element driving device as defined in claim 1, wherein: the picture data signals are cascade-connected between the driving circuits, and the output control means, up to the output of the start pulse signal to the driving circuit on the next stage or up to a predetermined time earlier than the output, stops the output of the picture data signals to the driving circuit at the next stage.

6. The display element driving device as defined in claim 5, wherein the output control means outputs the picture data signals to the driving circuit at the next stage based upon one of the outputs of the transfer means.

7. The display element driving device as defined in claim 7, wherein:

the output control means outputs the picture data signals to the driving circuit at the next stage based on one of the outputs of the transfer means, so as to stop the output of the picture data signals to the driving circuit at the next stage up to the predetermined time, where the one of the outputs of the transfer means is earlier than a last output of the transfer means.

8. The display element driving device as defined in claim 5, wherein the output control means outputs the clock signal to the driving circuit at the next stage based upon one of the outputs of the transfer means.

9. The display element driving device as defined in claim 8, wherein the output control means outputs the picture data signals to the driving circuit at the next stage based upon one of the outputs of the transfer means.

10. A display element driving device comprising:

a plurality of driving circuits that drive a display element based upon picture data signals, the driving circuit being provided with:

a transfer section for shifting and transferring a start pulse signal that is cascade-connected between the driving circuits, synchronizing to a clock signal that is cascade-connected between the driving circuits;

a selection section for selecting the picture data signals based upon the output of the transfer section; and a latch section for latching the picture data signals selected by the selection section by using a latch signal, wherein each of the driving circuits is provided with an output control section which, up to the output of the start pulse signal to the driving circuit on the next stage or up to a predetermined time earlier than the output, stops the output of the clock signal to the driving circuit at the next stage.

11. The display element driving device as defined in claim 10, wherein power-supply-related voltages are supplied to the respective driving circuits by utilizing wiring that is cascade-connected between the driving circuits.

12. The display element driving device as defined in claim 10, wherein the output control section outputs the clock signal to the driving circuit at the next stage based upon one of the outputs of the transfer section.

13. The display element driving device as defined in claim 12, wherein:

the output control section outputs the clock signal to the driving circuit at the next stage based on one of the outputs of the transfer section, so as to stop the output of the clock signal to the driving circuit at the next stage up to the predetermined time, where the one of the outputs of the transfer section is earlier than a last output of the transfer section.

14. The display element driving device as defined in claim 10, wherein: the picture data signals are cascade-connected between the driving circuits, and the output control section, up to the output of the start pulse signal to the driving circuit on the next stage or up to a predetermined time earlier than the output, stops the output of the picture data signals to the driving circuit at the next stage.

15. The display element driving device as defined in claim 14, wherein the output control section outputs the clock signal to the driving circuit at the next stage based upon one of the outputs of the transfer section.

16. The display element driving device as defined in claim 15, wherein the output control section outputs the picture data signals to the driving circuit at the next stage based upon one of the outputs of the transfer section.

17. The display element driving device as defined in claim 14, wherein the output control section outputs the picture data signals to the driving circuit at the next stage based upon one of the outputs of the transfer section.

18. The display element driving device as defined in claim 17, wherein:

the output control section outputs the picture data signals to the driving circuit at the next stage based on one of the outputs of the transfer section, so as to stop the output of the picture data signals to the driving circuit at the next stage up to the predetermined time, where the one of the outputs of the transfer section is earlier than a last output of the transfer section.

19. A display element driving device comprising:

a plurality of source-side driving circuits that drive a display element based upon picture data signals, the source-side driving circuit being provided with:

a shift register for shifting and transferring a start pulse signal that is cascade-connected between the source-side driving circuits, synchronizing to a clock signal that is cascade-connected between the source-side driving circuits;

a sampling memory for selecting the picture data signals based upon the output of the shift register; and a hold memory for latching the picture data signals selected by the sampling memory by using a latch signal, wherein each of the driving circuits is provided with an output control circuit which, up to the output of the start pulse signal to the source-side driving circuit on the next stage or up to a predetermined time earlier than the output, stops the output of the clock signal to the source-side driving circuit at the next stage.

20. The display element driving device as defined in claim 19, wherein power-supply-related voltages are supplied to the respective source-side driving circuits by utilizing wiring that is cascade-connected between the source-side driving circuits.

21. The display element driving device as defined in claim 19, wherein:

the output control circuit outputs the clock signal to the source-side driving circuit at the next stage based on one of the outputs of the shift register, so as to stop the output of the clock signal to the source-side driving circuit at the next stage up to the predetermined time, where the one of the outputs of the shift register is earlier than a last output of the shift register.

22. The display element driving device as defined in claim 19, wherein: the picture data signals are cascade-connected between the source-side driving circuits, and the output control circuit, up to the output of the start pulse signal to the source-side driving circuit on the next stage or up to a predetermined time earlier than the output, stops the output of the picture data signals to the source-side driving circuit at the next stage.

23. The display element driving device as defined in claim 22, wherein:

the output control circuit outputs the picture data signals to the source-side driving circuit at the next stage based on one of the outputs of the shift register, so as to stop the output of the picture data signals to the source-side driving circuit at the next stage up to the predetermined time, where the one of the outputs of the shift register is earlier than a last output of the shift register.

24. A display module comprising:

a display element driving device comprising a plurality of driving circuits that drive a display element based upon picture data signals, the driving circuit being provided with: a transfer means for shifting and transferring a start pulse signal that is cascade-connected between the driving circuits, synchronizing to a clock signal that is cascade-connected between the driving circuits, a selection means for selecting the picture data signals based upon the output of the transfer means, a latch means for latching the picture data signals selected by the selection means by using a latch signal, and an output control means which, up to the output of the start pulse signal to the driving circuit on the next stage or up to a predetermined time earlier than the output, stops the output of the clock signal to the driving circuit at the next stage; and a display element driven by the display element driving device.

25. The display module as defined in claim 24, wherein: driving circuit connecting wiring is placed on a substrate forming the display element, and the mutually adjacent driving circuits are connected by using the driving circuit connecting wiring.

26. The display module as defined in claim 24 wherein:

the output control means outputs the clock signal to the driving circuit at the next stage based on one of the outputs of the transfer means, so as to stop the output of the clock signal to the driving circuit at the next stage up to the predetermined time, where the one of the outputs of the transfer means is earlier than a last output of the transfer means.

27. A display module comprising:

a display element driving device comprising a plurality of driving circuits that drive a display element based upon picture data signals, the driving circuit being provided with: a transfer means for shifting and transferring a start pulse signal that is cascade-connected between the driving circuits, synchronizing to a clock signal that is cascade-connected between the driving circuits, a selection means for selecting the picture data signals based upon the output of the transfer means, a latch means for latching the picture data signals selected by the selection means by using a latch signal, and an output control means which, up to the output of the start pulse signal to the driving circuit on the next stage or up to a predetermined time earlier than the output, stops the output of the clock signal and the picture data signals to the driving circuit at the next stage; and a display element driven by the display element driving device.

28. The display module as defined in claim 27, wherein:

the output control means outputs the clock signal and the picture data signals to the driving circuit at the next stage based on one of the outputs of the transfer means, so as to stop the output of the clock signal and the picture data signals to the driving circuit at the next stage up to the predetermined time, where the one of the outputs of the transfer means is earlier than a last output of the transfer means.

29. A display module comprising:

a display element driving device comprising a plurality of driving circuits that drive a display element based upon picture data signals, the driving circuit being provided with: a transfer section for shifting and transferring a start pulse signal that is cascade-connected between the driving circuits, synchronizing to a clock signal that is cascade-connected between the driving circuits, a selection section for selecting the picture data signals based upon the output of the transfer section, a latch section for latching the picture data signals selected by the selection section by using a latch signal, and an output control section which, up to the output of the start pulse signal to the driving circuit on the next stage or up to a predetermined time earlier than the output, stops the output of the clock signal to the driving circuit at the next stage; and a display element driven by the display element driving device.

30. The display module as defined in claim 29, wherein: driving circuit connecting wiring is placed on a substrate forming the display element, and the mutually adjacent driving circuits are connected by using the driving circuit connecting wiring.

31. The display module as defined in claim 29, wherein:

the output control section outputs the clock signal to the driving circuit at the next stage based on one of the outputs of the transfer section, so as to stop the output of the clock signal to the driving circuit at the next stage up to the predetermined time, where the one of the outputs of the transfer section is earlier than a last output of the transfer section.

32. A display module comprising:

a display element driving device comprising a plurality of driving circuits that drive a display element based upon picture data signals, the driving circuit being provided with: a transfer section for shifting and transferring a start pulse signal that is cascade-connected between the driving circuits, synchronizing to a clock signal that is cascade-connected between the driving circuits, a selection section for selecting the picture data signals based upon the output of the transfer section, a latch section for latching the picture data signals selected by the selection section by using a latch signal, and an output control section which, up to the output of the start pulse signal to the driving circuit on the next stage or up to a predetermined time earlier than the output, stops the output of the clock signal and the picture data signals to the driving circuit at the next stage; and a display element driven by the display element driving device.

33. The display module as defined in claim 32, wherein:

the output control section outputs the clock signal and the picture data signals to the driving circuit at the next stage based on one of the outputs of the transfer section, so as to stop the output of the clock signal and the picture data signals to the driving circuit at the next stage up to the predetermined time, where the one of the outputs of the transfer section is earlier than a last output of the transfer section.

34. A display module comprising:

a display element driving device comprising a plurality of source-side driving circuits that drive a display element based upon picture data signals, the source-side driving circuit being provided with: a shift register for shifting and transferring a start pulse signal that is cascade-connected between the source-side driving circuits, synchronizing to a clock signal that is cascade-connected between the source-side driving circuits, a sampling memory for selecting the picture data signals based upon the output of the shift register, a hold memory for latching the picture data signals selected by the sampling memory by using a latch signal, and an output control circuit which, up to the output of the start pulse signal to the source-side driving circuit on the next stage or up to a predetermined time earlier than the output, stops the output of the clock signal to the source-side driving circuit at the next stage; and a display element driven by the display element driving device.

35. The display module as defined in claim 34, wherein: source-side driving circuit connecting wiring is placed on a substrate forming the display element, and the mutually adjacent source-side driving circuits are connected by using the source-side driving circuit connecting wiring.

36. The display module as defined in claim 34, wherein:

the output control circuit outputs the clock signal to the source-side driving circuit at the next stage based on one of the outputs of the shift register, so as to stop the output of the clock signal to the so side driving circuit at the next stage up to the predetermined time, where the one of the outputs of the shift register is earlier than a last output of the shift register.

37. A display module comprising:

a display element driving device comprising a plurality of source-side driving circuits that drive a display element based upon picture data signals, the source-side driving circuit being provided with:

a shift register for shifting and transferring a start pulse signal that is cascade-connected between the source-side driving circuits, synchronizing to a clock signal that is cascade-connected between the source-side driving circuits, a sampling memory for selecting the picture data signals based upon the output of the shift register, a hold memory for latching the picture data signals selected by the sampling memory by using a latch signal, and an output control circuit for allowing an output of the clock signal and the picture data signals to the source-side driving circuit at a next stage at a predetermined time earlier than the output of the start pulse signal at said next stage; and a display element driven by the display element driving device.

38. The display module as defined in claim 37, wherein:

the output control circuit outputs the clock signal and the picture data signals to the source-side driving circuit at the next stage based on one of the outputs of the shift register, so as to stop the output of the clock signal and the picture data signals to the source-side driving circuit at the next stage up to the predetermined time, where the one of the outputs of the shift register is earlier than a last output of the shift register.

* * * * *